US010629316B2

(12) United States Patent
Fujita et al.

(10) Patent No.: US 10,629,316 B2
(45) Date of Patent: Apr. 21, 2020

(54) RADIOACTIVE WASTE PROCESSING METHOD

(71) Applicant: RIKEN, Saitama (JP)

(72) Inventors: Reiko Fujita, Saitama (JP); Hideaki Otsu, Saitama (JP); Teiichiro Matsuzaki, Saitama (JP); Hiroyoshi Sakurai, Saitama (JP); Susumu Shimoura, Tokyo (JP); Koji Mizuguchi, Tokyo (JP); Hiroyuki Oigawa, Ibaraki-Ken (JP); Masaki Ozawa, Saitama (JP); Koji Nitta, Ibaraki-Ken (JP)

(73) Assignee: RIKEN, Saitama (JP)

( * ) Notice: Subject to any disclaimer, the term of this patent is extended or adjusted under 35 U.S.C. 154(b) by 198 days.

(21) Appl. No.: 15/559,736

(22) PCT Filed: Mar. 22, 2016

(86) PCT No.: PCT/JP2016/058949
§ 371 (c)(1),
(2) Date: Sep. 19, 2017

(87) PCT Pub. No.: WO2016/152840
PCT Pub. Date: Sep. 29, 2016

(65) Prior Publication Data

US 2018/0047473 A1 Feb. 15, 2018

(30) Foreign Application Priority Data

Mar. 20, 2015 (JP) ..... 2015-057179

(51) Int. Cl.
*G21G 1/08* (2006.01)
*G21K 5/08* (2006.01)
(Continued)

(52) U.S. Cl.
CPC ..... *G21G 1/08* (2013.01); *G21F 9/00* (2013.01); *G21F 9/007* (2013.01); *G21F 9/30* (2013.01);
(Continued)

(58) Field of Classification Search
CPC .. G21G 1/08; G21G 1/10; G21K 5/08; H05H 6/00; G21F 9/00; G21F 9/007
See application file for complete search history.

(56) References Cited

U.S. PATENT DOCUMENTS 4,721,596 A * 1/1988 Marriott ..... G21F 9/00 376/158
2002/0169351 A1 11/2002 Brown
2007/0242790 A1* 10/2007 Lou ..... H05H 3/06 376/156

FOREIGN PATENT DOCUMENTS

EP 0030404 A1 6/1981
EP 0990238 B1 5/2006
(Continued)

OTHER PUBLICATIONS

Goyal, Sneh Lata, and Pratibha Gur. "Empirical relation and establishment of shell effects in (n, 2n) reaction cross-sections at 14 MeV." Pramana 72.2 (2009): 355-362. <https://link.springer.com/content/pdf/10.1007/s12043-009-0031-x.pdf.> (Year: 2009).*
(Continued)

*Primary Examiner* — Lily C Garner
(74) *Attorney, Agent, or Firm* — Nakanishi IP Associates, LLC

(57) ABSTRACT

Provided is a fission product processing method for selectively transmuting only a long-lived radionuclide from fission products. The method for processing radioactive waste includes the step of extracting, from the radioactive waste, the isotopes without isotope separation, the isotope elements including radionuclides of fission products and having a
(Continued)

common atomic number, and the step of irradiating the isotopes with high-energy particles generated by an accelerator to produce nuclear transmutation of a long-lived radionuclide of the radionuclides into a short-lived radionuclide with a short half-life or a stable nuclide re-utilizable as a resource.

2 Claims, 15 Drawing Sheets

(51) Int. Cl.

| | |
|---|---|
| ***G21G 1/10*** | (2006.01) |
| ***H05H 6/00*** | (2006.01) |
| ***G21F 9/30*** | (2006.01) |
| ***G21F 9/00*** | (2006.01) |

(52) U.S. Cl.
CPC ..... *G21G 1/10* (2013.01); *G21K 5/08* (2013.01); *H05H 6/00* (2013.01)

(56) References Cited

FOREIGN PATENT DOCUMENTS

| | | | |
|---|---|---|---|
| JP | S56-125698 | A | 10/1981 |
| JP | H05-119178 | A | 5/1993 |
| JP | 3145555 | B2 | 3/2001 |
| JP | 2002-519678 | A | 7/2002 |

OTHER PUBLICATIONS

Fujita, Reiko. Technology and development of long half-life fission products nuclear transmutation technology in IMPACT program. Translation. 15 pages. Japanese version available online: <http://www.mext.go.jp/b_menu/shingi/gijyutu/gijyutu2/070/shiryo/_icsFiles/afieldfile/2014/09/11/1351595_1.pdf>. (Year: 2014).*

International Preliminary Report on Patentability dated on Sep. 26, 2017 with Written Opinion of International Searching Authority (WOSA) dated Jun. 7, 2016, issued in PCT/JP2016/058949, and English translation of WOSA (10 pages).

Reiko Fujita, "ImPACT ni Okeru Chohangenki FP Kaku Henkan Gijutsu Kaihatsu" [online] Aug. 20, 2014 URL:http://www.mext.go.jp/b menu/shingi/gijyutu/gijyutu2/070/shiro/ icsFiles/afieldfile/2014/09/11/1351595 1.pdf (15 pages).

International Search Report issued in PCT/JP2016/058949, dated Jun. 7, 2016, with translation (5 pages).

Communication pursuant to Article 94(3) EPC issued in European Patent Application No. 16768743.3, dated Apr. 23, 2019 (6 pages).

XP001207420, Lisowski P W et al: "The Los Alamos National Laboratory Spallation Neutron Sources", Nuclear Science and Engineering, vol. 106, No. 2, (Oct. 1, 1990), pp. 208-218, ISSN: 0029-5639 (11 pages).

XP004082398, Uwamino Y et al: "High-energy p-Li neutron field for activation experiment", Nuclear Instruments & Methods in Physics Research. Section A, Elsevier BV North-Holland, NL, vol. 389, No. 3, (Apr. 21, 1997), pp. 463-473, ISSN: 0168-9002, DOI: 10. 1016/S0168-9002(97)00345-8 (11 pages).

XP055580247, R R Borchers et al: "Neutrons from Proton Bombardment of Lithium", (Jan. 1, 1963), p. 15. (6 pages).

Office Action dated Feb. 26, 2018, issued in Korean Patent Application No. 10-2017-7029827, with English Translation (10 pages).

* cited by examiner

Se (Z = 34)

N = 42 N = 44 N = 46

| | | | | | | | | |
|---|---|---|---|---|---|---|---|---|
| Br75 96.7m | Br76 16.2h | Br77 57.0h | Br78 6.46m | Br79 ∞ | Br80 17.68m | Br81 ∞ | Br82 35.3h | Br83 2.40h |
| Se74 ∞ | Se75 120d | Se76 ∞ | Se77 ∞ | Se78 ∞ | Se79 3E5y | Se80 ∞ | Se81 18.45m | Se82 ∞ |
| As73 80.3d | As74 17.8d | As75 ∞ | As76 1.08d | As77 38.8h | As78 90.7m | As79 9.01m | As80 15.2s | As81 33.3s |

N = 41 N = 43 N = 45 N = 47

| Pd (Z = 46) | | | N = 58 | | N = 60 | | N = 62 | | N = 64 | |
|---|---|---|---|---|---|---|---|---|---|---|
| Ag102 12.9m | Ag103 65.7m | Ag104 69.2m | Ag105 41.3m | Ag106 24.0m | Ag107 ∞ | Ag108 2.37m | Ag109 ∞ | Ag110 24.6s | Ag111 7.45d | Ag112 3.13h |
| Pd101 8.47h | Pd102 ∞ | Pd103 17.0d | Pd104 ∞ | Pd105 ∞ | Pd106 ∞ | Pd107 6.5E6y | Pd108 ∞ | Pd109 13.7h | Pd110 ∞ | Pd111 23.4m |
| Rh100 20.8h | Rh101 3.3y | Rh102 207d | Rh103 ∞ | Rh104 42.3s | Rh105 35.4h | Rh106 29.8s | Rh107 21.7m | Rh108 6.0m | Rh109 80s | Rh110 3.2s |
| | | | | N = 59 | | N = 61 | | N = 63 | | |

Zr (Z = 40)

N = 50 N = 52 N = 54

| | | | | | | | | | |
|---|---|---|---|---|---|---|---|---|---|
| Mo89<br>2.04m | Mo90<br>5.67h | Mo91<br>15.5m | Mo92<br>∞ | Mo93<br>4.0E3y | Mo94<br>∞ | Mo95<br>∞ | Mo96<br>∞ | Mo97<br>∞ | Mo98<br>∞ |
| Nb88<br>14.55m | Nb89<br>2.03h | Nb90<br>14.6h | Nb91<br>680y | Nb92<br>3.47E7y | Nb93<br>∞ | Nb94<br>2.03E4y | Nb95<br>35.0d | Nb96<br>23.4h | Nb97<br>1.20h |
| Zr87<br>1.68h | Zr88<br>83.4d | Zr89<br>78.4h | Zr90<br>∞ | Zr91<br>∞ | Zr92<br>∞ | Zr93<br>1.5E6y | Zr94<br>∞ | Zr95<br>64.0d | Zr96<br>∞ |

N = 51 N = 53 N = 55

Kr (Z = 36)

N = 44 N = 46 N = 48 N = 50

| | | | | | | | | | | |
|---|---|---|---|---|---|---|---|---|---|---|
| Rb78 17.7m | Rb79 22.9m | Rb80 34s | Rb81 4.58h | Rb82 1.27m | Rb83 86.2d | Rb84 32.8m | Rb85 ∞ | Rb86 18.6d | Rb87 5E10y | Rb88 17.8m |
| Kr77 74.4m | Kr78 ∞ | Kr79 35.0m | Kr80 ∞ | Kr81 2.3E5y | Kr82 ∞ | Kr83 ∞ | Kr84 ∞ | Kr85 10.8y | Kr86 ∞ | Kr87 76.3m |
| Br76 16.2h | Br77 57.0h | Br78 6.46m | Br79 ∞ | Br80 17.7m | Br81 ∞ | Br82 35.3h | Br83 2.4h | Br84 31.8m | Br85 2.90m | Br86 55.1s |

N = 45 N = 47 N = 49

Sm (Z = 62)

N = 85 N = 87 N = 89 N = 91

| | | | | | | | | | | |
|---|---|---|---|---|---|---|---|---|---|---|
| Eu145 5.93d | Eu146 4.59d | Eu147 24.1d | Eu148 54.5d | Eu149 93.1d | Eu150 36.9y | Eu151 ∞ | Eu152 13.5d | Eu153 ∞ | Eu154 8.59y | Eu155 4.76y |
| Sm144 ∞ | Sm145 340d | Sm146 1E8y | Sm147 1E11y | Sm148 7E15y | Sm149 2E15y | Sm150 ∞ | Sm151 90y | Sm152 ∞ | Sm153 46.3h | Sm154 ∞ |
| Pm143 265d | Pm144 363d | Pm145 17.7y | Pm146 5.53y | Pm147 2.62y | Pm148 5.37d | Pm149 53.1h | Pm150 2.68h | Pm151 28.4h | Pm152 4.12m | Pm153 5.4m |

N = 86 N = 88 N = 90

Cs (Z = 55)

N = 78 N = 80 N = 82

| | | | | | | | | | |
|---|---|---|---|---|---|---|---|---|---|
| Ba131 11.5d | Ba132 ∞ | Ba133 10.5y | Ba134 ∞ | Ba135 ∞ | Ba136 ∞ | Ba137 ∞ | Ba138 ∞ | Ba139 83.1m | Ba140 12.8d |
| Cs130 29.2m | Cs131 9.69d | Cs132 6.48d | Cs133 ∞ | Cs134 2.07y | Cs135 2.3E6y | Cs136 13.2d | Cs137 30.1y | Cs138 33.4m | Cs139 9.27m |
| Xe129 ∞ | Xe130 ∞ | Xe131 ∞ | Xe132 ∞ | Xe133 5.24d | Xe134 ∞ | Xe135 9.14h | Xe136 2.4E21y | Xe137 3.82m | Xe138 14.1m |

N = 77 N = 79 N = 81 N = 83

Sr (Z = 38)

N = 48 N = 50 N = 52

| | | | | | | | | |
|---|---|---|---|---|---|---|---|---|
| Y84<br>4.6s | Y85<br>2.68h | Y86<br>14.7h | Y87<br>79.8h | Y88<br>107d | Y89<br>∞ | Y90<br>64.1h | Y91<br>58.5d | Y92<br>3.54 |
| Sr83<br>32.4h | Sr84<br>∞ | Sr85<br>64.8d | Sr86<br>∞ | Sr87<br>∞ | Sr88<br>∞ | Sr89<br>50.5d | Sr90<br>28.8y | Sr91<br>9.63h |
| Rb82<br>1.27m | Rb83<br>86.2d | Rb84<br>32.8d | Rb85<br>∞ | Rb86<br>18.6d | Rb87<br>5e10y | Rb88<br>17.8m | Rb89<br>15.6m | Rb90<br>158s |

N = 47 N = 49 N = 51

Sn (Z = 50) N = 71 N = 73 N = 75

| | | | | | | | | | | |
|---|---|---|---|---|---|---|---|---|---|---|
| Te119 16.0h | Te120 ∞ | Te121 16.8d | Te122 ∞ | Te123 1E13y | Te124 ∞ | Te125 ∞ | Te126 ∞ | Te127 9.35h | Te128 2E24y | Te129 69.6m |
| Sb118 3.6m | Sb119 38.2h | Sb120 15.9m | Sb121 ∞ | Sb122 2.72d | Sb123 ∞ | Sb124 60.2d | Sb125 2.76y | Sb126 12.5d | Sb127 3.85d | Sb128 9.01h |
| Sn117 ∞ | Sn118 ∞ | Sn119 ∞ | Sn120 ∞ | Sn121 27.1h | Sn122 ∞ | Sn123 129d | Sn124 ∞ | Sn125 9.64d | Sn126 1E5y | Sn127 2.10h |

N = 70 N = 72 N = 74

MUON NUCLEAR CAPTURE REACTION $${}^{A}_{Z}X(\mu^{-},\nu)_{Z-1}{}^{A}Y \quad ①$$

$${}^{A}_{Z}X(\mu^{-},n\,\nu){}^{A-1}_{Z-1}Y \quad ②$$

$${}^{A}_{Z}X(\mu^{-},2n\,\nu){}^{A-2}_{Z-1}Y \quad ③$$

$${}^{A}_{Z}X(\mu^{-},3n\,\nu){}^{A-3}_{Z-1}Y \quad ④$$

$${}^{A}_{Z}X(\mu^{-},4n\,\nu){}^{A-4}_{Z-1}Y \quad ⑤$$

Se (Z = 34)

N = 42 N = 44 N = 46

| | | | | | | | | |
|---|---|---|---|---|---|---|---|---|
| Se74 ∞ | Se75 120d | Se76 ∞ | Se77 ∞ | Se78 ∞ | Se79 3E5y | Se80 ∞ | Se81 18.45m | Se82 ∞ |
| As73 80.3d | As74 17.8d | As75 ∞ | As76 1.08d | As77 38.8h | As78 90.7m | As79 9.01m | As80 15.2s | As81 33.3s |
| Ge72 ∞ | Ge73 ∞ | Ge74 ∞ | Ge75 82.8m | Ge76 ∞ | Ge77 11.3h | Ge78 88.0m | Ge79 19.0s | Ge80 29.5s |

N = 41 N = 43 N = 45 N = 47

FIG. 12

Pd (Z = 46)

N = 58 N = 60 N = 62 N = 64

| | | | | | | | | | | |
|---|---|---|---|---|---|---|---|---|---|---|
| Pd101 8.47h | Pd102 ∞ | Pd103 17.0d | Pd104 ∞ | Pd105 ∞ | Pd106 ∞ | Pd107 6.5E6y | Pd108 ∞ | Pd109 13.7h | Pd110 ∞ | Pd111 23.4m |
| Rh100 20.8h | Rh101 3.3y | Rh102 207d | Rh103 ∞ | Rh104 42.3s | Rh105 35.4h | Rh106 29.8s | Rh107 21.7m | Rh108 6.0m | Rh109 80s | Rh110 3.2s |
| Ru99 ∞ | Ru100 ∞ | Ru101 ∞ | Ru102 ∞ | Ru103 39.3d | Ru104 ∞ | Ru105 4.44h | Ru106 373d | Ru107 3.75m | Ru108 4.55m | Ru109 34.5s |

N = 59 N = 61 N = 63

FIG. 13

Sr (Z = 38)

N = 48 N = 50 N = 52

| | | | | | | | | |
|---|---|---|---|---|---|---|---|---|
| Y84<br>4.6s | Y85<br>2.68h | Y86<br>14.7h | Y87<br>79.8h | Y88<br>107d | Y89<br>∞ | Y90<br>64.1h | Y91<br>58.5d | Y92<br>3.54 |
| Sr83<br>32.4h | Sr84<br>∞ | Sr85<br>64.8d | Sr86<br>∞ | Sr87<br>∞ | Sr88<br>∞ | Sr89<br>50.5d | Sr90<br>28.8y | Sr91<br>9.63h |
| Rb82<br>1.27m | Rb83<br>86.2d | Rb84<br>32.8d | Rb85<br>∞ | Rb86<br>18.6d | Rb87<br>5e10y | Rb88<br>17.8m | Rb89<br>15.6m | Rb90<br>158s |

N = 47 N = 49 N = 51

FIG. 14

Zr (Z = 40)

N = 50 N = 52 N = 54 N = 56

| | | | | | | | | | | |
|---|---|---|---|---|---|---|---|---|---|---|
| Zr87<br>1.68h | Zr88<br>83.4d | Zr89<br>78.4h | Zr90<br>∞ | Zr91<br>∞ | Zr92<br>∞ | Zr93<br>1.5E6y | Zr94<br>∞ | Zr95<br>64.0d | Zr96<br>4E19y | Zr97<br>16.9h |
| Y86<br>14.7h | Y87<br>79.8h | Y88<br>106d | Y89<br>∞ | Y90<br>64.1h | Y91<br>58.5d | Y92<br>3.54h | Y93<br>10.2h | Y94<br>18.7m | Y95<br>10.3m | Y96<br>5.34s |
| Sr85<br>64.8d | Sr86<br>∞ | Sr87<br>∞ | Sr88<br>∞ | Sr89<br>50.5d | Sr90<br>28.8y | Sr91<br>9.63h | Sr92<br>2.71h | Sr93<br>7.42m | Sr94<br>75.3s | Sr95<br>23.9s |

N = 51 N = 53 N = 55

FIG. 15

Cs (Z = 55)

N = 78 N = 80 N = 82

| | | | | | | | | | |
|---|---|---|---|---|---|---|---|---|---|
| Ba131<br>11.5d | Ba132<br>∞ | Ba133<br>10.5y | Ba134<br>∞ | Ba135<br>∞ | Ba136<br>∞ | Ba137<br>∞ | Ba138<br>∞ | Ba139<br>83.1m | Ba140<br>12.8d |
| Cs130<br>29.2m | Cs131<br>9.69d | Cs132<br>6.48d | Cs133<br>∞ | Cs134<br>2.07y | Cs135<br>2.3E6y | Cs136<br>13.2d | Cs137<br>30.1y | Cs138<br>33.4m | Cs139<br>9.27m |
| Xe129<br>∞ | Xe130<br>∞ | Xe131<br>∞ | Xe132<br>∞ | Xe133<br>5.24d | Xe134<br>∞ | Xe135<br>9.14h | Xe136<br>2.4E21y | Xe137<br>3.82m | Xe138<br>14.1m |

N = 77 N = 79 N = 81 N = 83

FIG. 16

Sn (Z = 50)

N = 71 N = 73 N = 75

| | | | | | | | | | | |
|---|---|---|---|---|---|---|---|---|---|---|
| Te119<br>16.0h | Te120<br>∞ | Te121<br>16.8d | Te122<br>∞ | Te123<br>1E13y | Te124<br>∞ | Te125<br>∞ | Te126<br>∞ | Te127<br>9.35h | Te128<br>2E24y | Te129<br>69.6m |
| Sb118<br>3.6m | Sb119<br>38.2h | Sb120<br>15.9m | Sb121<br>∞ | Sb122<br>2.72d | Sb123<br>∞ | Sb124<br>60.2d | Sb125<br>2.76y | Sb126<br>12.5d | Sb127<br>3.85d | Sb128<br>9.01h |
| Sn117<br>∞ | Sn118<br>∞ | Sn119<br>∞ | Sn120<br>∞ | Sn121<br>27.1h | Sn122<br>∞ | Sn123<br>129d | Sn124<br>∞ | Sn125<br>9.64d | Sn126<br>1E5y | Sn127<br>2.10h |
| In116<br>14.1s | In117<br>43.2m | In118<br>5.0s | In119<br>2.4m | In120<br>3.1s | In121<br>23.1s | In122<br>1.5s | In123<br>5.98s | In124<br>3.11s | In125<br>2.36s | In126<br>1.60s |

N = 70 N = 72 N = 74

FIG. 17

Sm (Z = 62)

N = 85 N = 87 N = 89 N = 91

| | | | | | | | | | | |
|---|---|---|---|---|---|---|---|---|---|---|
| Sm144<br>∞ | Sm145<br>340d | Sm146<br>1E8y | Sm147<br>1E11y | Sm148<br>7E15y | Sm149<br>2E15y | Sm150<br>∞ | Sm151<br>90y | Sm152<br>∞ | Sm153<br>46.3h | Sm154<br>∞ |
| Pm143<br>265d | Pm144<br>363d | Pm145<br>17.7y | Pm146<br>5.53y | Pm147<br>2.62y | Pm148<br>5.37d | Pm149<br>53.1h | Pm150<br>2.68h | Pm151<br>28.4h | Pm152<br>4.12m | Pm153<br>5.4m |
| Nd142<br>∞ | Nd143<br>∞ | Nd144<br>2E15y | Nd145<br>∞ | Nd146<br>∞ | Nd147<br>11.0d | Nd148<br>∞ | Nd149<br>1.73h | Nd150<br>∞ | Nd151<br>12.4m | Nd152<br>11.4m |

N = 86 N = 88 N = 90

FIG. 18

RADIOACTIVE WASTE PROCESSING METHOD

TECHNICAL FIELD

The present invention relates to the technique of processing high-level radioactive waste including fission products.

BACKGROUND ART

Electric power providers owning nuclear power plants have stored a massive amount of used nuclear fuel, and establishment of the method for safely and effectively processing such used nuclear fuel has been an urgent issue.

For this reason, study has been conducted on a nuclear fuel cycle that fissionable U-235 or Pu is extracted from the used nuclear fuel and about 3 to 5% of the resultant is mixed with non-fissionable U-238 to reproduce new fuel.

A used nuclear fuel of about 20 tons is annually produced or yielded from a 1000 MWe class nuclear power plant. Used nuclear fuel of 3%-enriched uranium fuel (U-235: 3%, U-238: 97%) contains 1% of U-235, 95% of U-238, 1% of Pu, and 3% of other products. These products are categorized into minor actinide (MA), platinum groups, short-lived fission products (SLFP), and long-lived fission products (LLFP).

Note that these products exhibit high neutron absorbing properties, and are the cause of interfering with progress of chain reaction of nuclear fission along with increasing of those amounts.

For this reason, these products are much contained in highly active liquid waste (HALW) inevitably caused by reprocessing of the used nuclear fuel and vitrified waste in such a form that the highly active liquid waste can be discarded.

When this highly active liquid waste (HALW) is, without change, formed into the vitrified waste for disposal, a massive amount of high-level radioactive waste generating heat needs to be managed for thousands of years, leading to a burden increase. Actually, the vitrified waste has been already held, and therefore, long-term management has been demanded.

For these reasons, for the purpose of reducing a burden due to disposal of the highly active liquid waste (HALW) and management of the already-held vitrified waste, study has been conducted on the technique of separating contained nuclides into groups according to a half-life or chemical properties and selecting, for each group, a disposal method according to properties. Thus, a storage period of the high-level radioactive waste can be shortened, and a storage space can be further saved.

For the groups with the long-lived fission products (LLFP) among the groups separated from the highly active liquid waste (HALW) and the vitrified waste, study has been conducted on application of the technique of nuclear transmutation into short-lived radionuclides or stable nuclides.

Specifically, the technique of nuclear transmutation into isotopes with a shorter half-life by application of photonuclear reaction (γ, n) for irradiating the long-lived fission products (LLFP) with a gamma beam to cause neutron emission or neutron capture reaction (n, γ) for irradiating the long-lived fission products (LLFP) with neutrons to cause gamma beam emission has been disclosed (e.g., Patent Literatures 1 and 2).

CITATION LIST

Patent Literature

Patent Literature 1: JP1993-119178A

Patent Literature 2: WO00/00986

However, in the above-described photonuclear reaction (γ, n) or neutron capture reaction (n, γ), long-lived radionuclides which can be efficiently nuclear-transmuted are limited due to high nuclide dependency of a reaction cross section.

For this reason, the long-lived radionuclides may be directly irradiated with a high-energy beam, or may be indirectly irradiated with a secondary beam generated from the high-energy beam. In this manner, nuclear transmutation can be effective.

Group separation as described above is based on element separation, and is not accompanied by isotope separation.

Thus, even when the long-lived fission products (LLFP) are separated into the groups, not only isotopes of the long-lived radionuclides but also isotopes of the short-lived radionuclides and the stable nuclides might be present in a mixed manner.

For this reason, when the groups with the long-lived fission products (LLFP) are, without thinking, irradiated with the high-energy beam to perform nuclear transmutation processing, there are concerns that the long-lived radionuclides are not only transmuted into the short-lived radionuclides or the stable nuclides, but also the short-lived radionuclides or the stable nuclides are nuclear-transmuted into the long-lived radionuclides.

Thus, the nuclear transmutation processing of extracting only the long-lived radionuclides by isotope separation is conceivable, but is not practical due to low productivity of isotope separation processing in a current situation.

Moreover, practically-applicable elements are limited in such isotope separation processing, and therefore, there is a limitation on application for the purpose of detoxifying of the long-lived fission products (LLFP) or re-utilization of the long-lived fission products (LLFP) as useful elements.

SUMMARY OF INVENTION

One or more embodiments of the present invention are directed to a fission product processing method for selective nuclear transmutation, without isotope separation, only the radionuclides into stable nuclides in the fission products.

In one or more embodiments of the present invention, a method for processing radioactive waste includes the step of extracting, from the radioactive waste, the isotopes without isotope separation, the isotopes including radionuclides of fission products and having a common atomic number, and the step of irradiating the isotopes with high-energy particles generated by an accelerator to produce nuclear transmutation of a long-lived radionuclide of the radionuclides into a short-lived radionuclide with a short half-life or a stable nuclide re-utilizable as a resource.

According to one or more embodiments of the present invention, the fission product processing method for selective nuclear transmutation, without isotope separation, only the radionuclides into stable nuclides in the fission products is provided.

Further, a radioactive waste processing method can be provided so that the stable nuclides transmuted from the long-lived radionuclides or the like can be re-utilized as the resource.

BRIEF DESCRIPTION OF DRAWINGS

FIG. 12 is the chart of nuclides for describing transition of the selenium isotope (Se) by the muon nuclear capture reaction.

FIG. 13 is the chart of nuclides for describing transition of the palladium isotope (Pd) by the muon nuclear capture reaction.

FIG. 14 is the chart of nuclides for describing transition of the strontium isotope (Sr) by the muon nuclear capture reaction.

FIG. 15 is the chart of nuclides for describing transition of the zirconium isotope (Zr) by the muon nuclear capture reaction.

FIG. 16 is the chart of nuclides for describing transition of the cesium isotope (Cs) by the muon nuclear capture reaction.

FIG. 17 is the chart of nuclides for describing transition of the tin isotope (Sn) by the muon nuclear capture reaction.

FIG. 18 is the chart of nuclides for describing transition of the samarium isotope (Sm) by the muon nuclear capture reaction.

DESCRIPTION OF EMBODIMENTS

An embodiment of the present invention will be described below based on the attached drawings.

Figure 1:
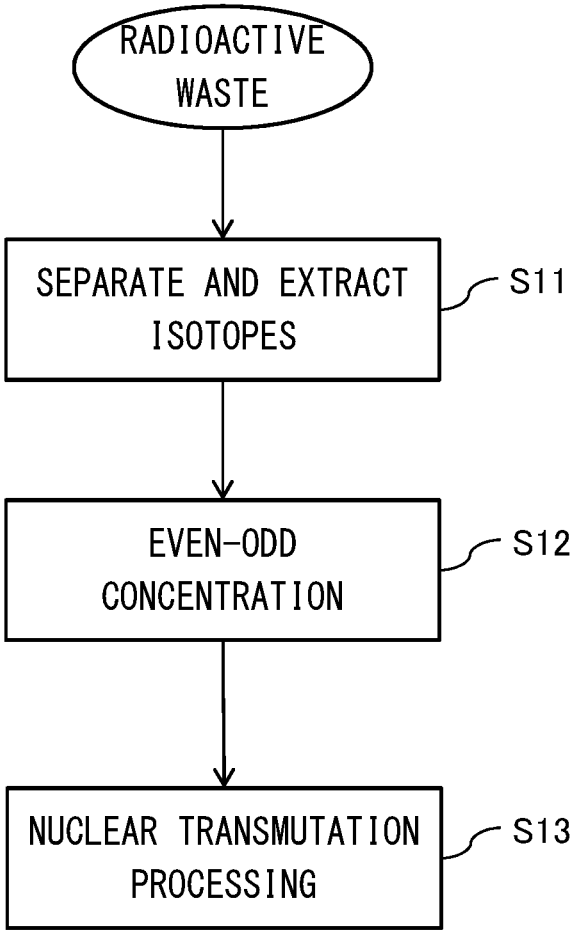
FIG. 1 is a flowchart for describing an embodiment of a radioactive waste processing method of the present invention.

As shown in FIG. 1, the method for processing radioactive waste according to the embodiment includes the step (S11) of separating and extracting, from the radioactive waste, the isotopes including radionuclides of fission products and having a common atomic number, and the step (S13) of irradiating the isotopes with high-energy particles generated by an accelerator to produce nuclear transmutation of long-lived radionuclides or mid-lived radionuclides into short-lived radionuclides with a short half-life or stable nuclides.

The method further includes, after the separation extraction step (S11) and before the nuclear transmutation step (S13), the step (S12) of concentrating, based on parity on a concentration effect, the isotopes into any one of an isotopes with an odd number of neutrons and an isotopes with an even number of neutrons.

Radioactive waste including fission products (FP) is assumed as the radioactive waste targeted for application in the present embodiment. These fission products (FP) indicate two or more nuclides separated by nuclear fission of fissionable nuclides such as uranium U-235 and plutonium Pu-239.

The element types of the fission product (FP) of the uranium U-235 are about 40 types from nickel (atomic number 28) to dysprosium (atomic number 66).

Yield distribution on the mass number of the fission product (FP) of the uranium U-235 is across a range of 72 to 160, and is in a double peak shape with local maximum values around a mass number of 90 and a mass number of 140.

As described above, there are several hundred types of fission products (FP) when distinguished according to isotopes, and these fission products (FP) are further categorized into stable nuclides and radionuclides. Of these nuclides, the radionuclides are changed into more stable nuclides by nuclear decay.

Short-lived radionuclides with a short half-life of nuclear decay emit a massive amount of radiation in a short amount of time, but radioactivity rapidly attenuates as time proceeds. For this reason, such radionuclides can be detoxified by storage for a predetermined period of time.

On the other hand, long-lived radionuclides with a long half-life emit a less amount of radiation, but the speed of attenuation is slower. For this reason, semi-permanent management is necessary in the case of massive possession.

Thus, when nuclear transmutation of the long-lived radionuclides into the short-lived radionuclides or the stable nuclides can be produced, a burden due to management of the radioactive waste can be reduced.

Major long-lived radionuclides (a half-life in parentheses) included in the fission products (FP) include, for example, selenium Se-79 ($2.95\times10^5$ years), palladium Pd-107 ($6.5\times10^6$ years), zirconium Zr-93 ($1.5\times10^6$ years), cesium Cs-135 ($2.3\times10^6$ years), iodine I-129 ($1.57\times10^7$ years), technetium Tc-99 ($2.1\times10^5$ years), and tin Sn-126 ($2.3\times10^5$ years).

For iodine I-129 ($1.57\times10^7$ years) and technetium Tc-99 ($2.1\times10^5$ years) of these radionuclides, examples showing effective life shortening by neutron capture reaction (n, $\gamma$) have been reported. For this reason, iodine I-129 and technetium Tc-99 are left out of consideration in the present embodiment, but the present invention is applicable to these radionuclides.

Note that in the present embodiment, radionuclides with a half-life of equal to or longer than $10^{10}$ years are regarded as metastable nuclides, and are excluded from processing targets.

Strontium Sr-90 (28.8 years), krypton Kr-85 (10.8 years), and samarium Sm-151 (90 years) as major fission products (FP) for mid-lived radionuclides with a half-life of exceeding 10 years are, even if these products are other than the above-described long-lived radionuclides, included in the processing targets for further life shortening, and study has been conducted on these products.

The separation extraction step (S11) of FIG. 1 is the step of separating and extracting, from the radioactive waste including various types of nuclides, the isotopes including the focused long-lived radionuclides. That is, the isotopes having the same atomic number (the number of protons) Z as that of the focused long-lived radionuclides and having different mass numbers (the number of protons+the number of neutrons) A is extracted.

A typical element separation method can be applied as such a method for separating and extracting the isotopes, and for example, includes an electrolytic method, a solvent extraction method, an ion exchanging method, a precipitation method, a dry method, or a combination thereof. In a case where vitrified waste is targeted, the vitrified waste needs to be melted or decomposed at a step before separation extraction. A typical melting/decomposition method can be applied, and for example, includes an alkali fusion method, a molten-salt method (electrolysis reduction, chemical reduction), a high-temperature fusion method, a halogenation method, an acid solution method, and an alkali melting method. After the vitrified waste has been melted or decomposed, the above-described typical element separation method can be applied.

The even-odd concentration step (S12) of FIG. 1 is the step of performing, for the isotopes subjected to the separation extraction step (S11), the processing of concentrating, based on the parity on the concentration effect, the isotopes into any one of the isotopes with the odd number of neutrons and the isotopes with the even number of neutrons.

After this even-odd concentration step (S12), the efficiency of the subsequent nuclear transmutation processing step (S13) is enhanced. Thus, this even-odd concentration step (S12) is not an essential step, and is not sometimes performed considering a total cost.

In general, isotope separation is performed utilizing a slight physical property difference or a slight mass difference, such as an isotope vapor pressure. An isotopic shift phenomenon has been known, in which the number of vibration of an atomic spectral line slightly shifts among isotopes, and an optical transition selection rule on light polarization varies among odd-number isotopes and even-number isotopes.

Utilizing such a phenomenon, the isotopes separated and extracted at (S11) can be, at (S12), concentrated into any one of the isotopes with the odd number of neutrons and the isotopes with the even number of neutrons.

Such an even-odd concentration step (S12) may use such properties that in the case of an even number of neutrons, the transition selection rule in the course of electronic excitation by a right/left circular polarization laser varies among even-even nuclei and even-odd nuclei with a nuclear spin of zero.

Specifically, only odd-number nuclides can be ionized by laser irradiation with a laser of which polarization has been controlled. Note that the method applied to the even-odd concentration step (S12) is not specifically limited.

The nuclear transmutation processing step (S13) of FIG. 1 will be described below separately for each type of irradiated high-energy particle and each type of separated and extracted isotopes.

(Secondary Neutron Emission Reaction; (n, xn) Reaction ($x \geq 2$))

First, a case where the high-energy particles with which the isotopes is irradiated are neutrons (n) will be described. The neutrons do not receive clone force due to the charge of atomic nuclei, and therefore, tend to enter the atomic nuclei to produce nucleus reaction.

Typically in a case where neutrons with low energy enter atomic nuclei, elastic scattering ((n, n) reaction) in which the sum of kinetic energy before and after entering is conserved is dominant. However, when the energy of the neutrons increases to above hundreds of kilo electron volts, inelastic scattering in which the sum of kinetic energy before and after entering is not conserved begins to occur.

Then, when the energy of the neutrons reaches equal to or higher than 1 MeV, reaction for emitting charged particles, such as (n, p) reaction or (n, $\alpha$) reaction, is produced. When the energy of the neutrons reaches 7 to 8 MeV, (n, 2n) reaction begins to occur, and therefore, secondary neutrons are emitted. Then, when the energy of the neutrons further increases, (n, 3n) reaction is produced.

The (n, 2n) reaction described herein is reaction that two neutrons are emitted from an atomic nucleus when a single neutron enters the atomic nucleus. The (n, 3n) reaction described herein is reaction that three neutrons are emitted from an atomic nucleus when a single neutron enters the atomic nucleus.

The magnitude of energy for separating and emitting a secondary neutron by entering of a primary neutron into an atomic nucleus shows tendency depending on the parity of the number of neutrons. In general, energy is lower in the case of taking a single neutron out of an atomic nucleus with an odd number of neutrons than in the case of taking a single neutron out of an atomic nucleus with an even number of neutrons.

Selective nuclear transmutation of a long-lived radionuclide or a mid-lived radionuclides into a short-lived radionuclide or a stable nuclide based on the parity of neutron separation energy of an isotope element by proper setting of neutron irradiation energy will be described below for each type of isotopes targeted for processing.

Figures 2A, 2B:
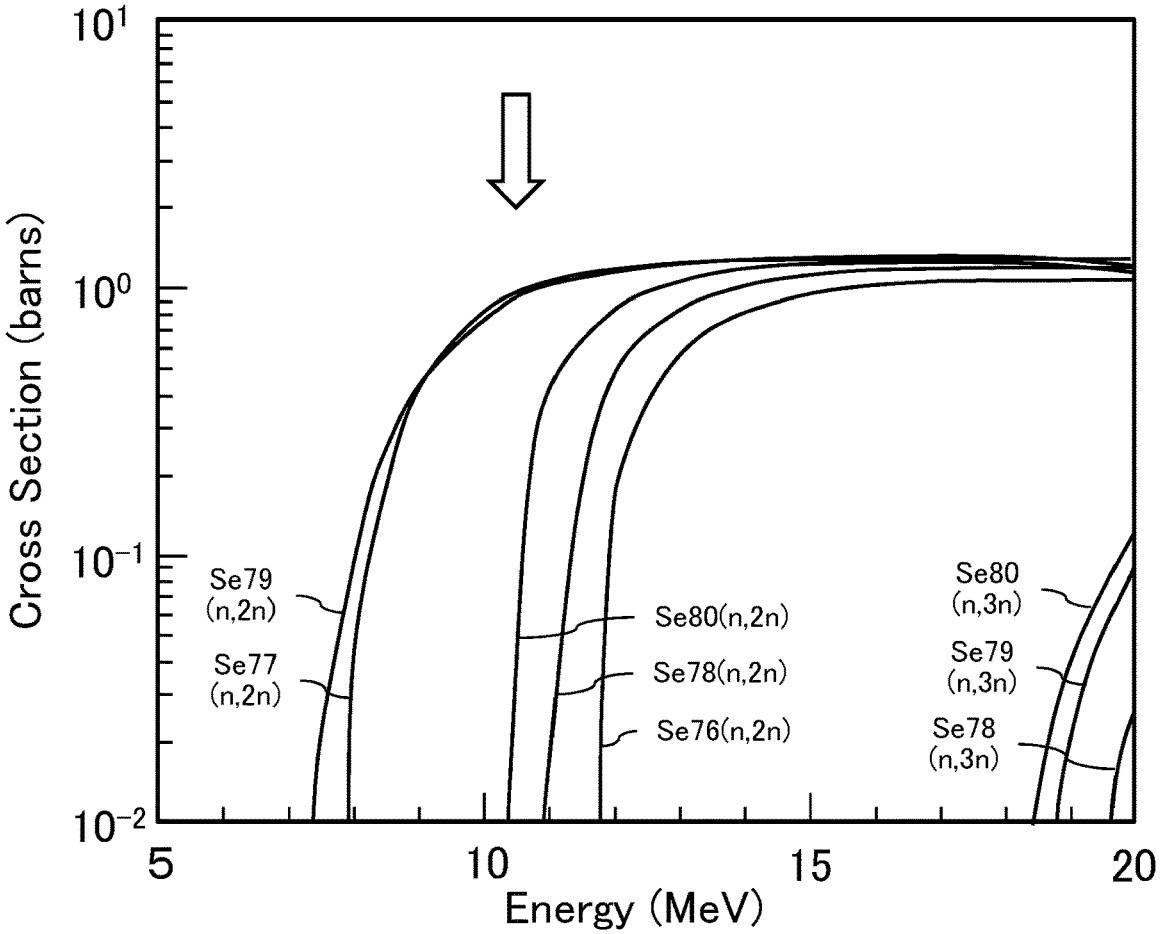
FIG. 2A is a graph of a neutron emission reaction cross section of a selenium isotope (Se) with respect to neutron irradiation energy.
FIG. 2B is the chart of nuclides for describing transition of the selenium isotope (Se) by (n, 2n) reaction.

FIG. 2A is a graph of a neutron emission reaction cross section of a selenium isotope (Se) with respect to the neutron irradiation energy. FIG. 2B is the chart of nuclides of major isotopes including bromine Br, selenium Se, and arsenic As.

For the Se isotopes, only Se-74, 76, 77, 78, 80, 82 as stable nuclides and Se-79 (a half-life of $2.95 \times 10^5$ years) as a long-lived radionuclide remain in the course of storage for a certain period of time and the separation extraction step (FIG. 1; S11), and almost all of other isotopes are transmuted due to nuclear decay.

Of these Se isotopes, a target for transmutation is Se-79 as the long-lived radionuclide.

As shown in FIG. 2A, when the neutron irradiation energy increases, the (n, 2n) reaction cross sections of Se-77 and Se-79 with an odd number of neutrons begin to increase at around the point of exceeding 7 MeV. Each nuclide loses a single neutron, leading to nuclear transmutation of these nuclides into Se-76 and Se-78.

When the neutron irradiation energy further increases, the (n, 2n) reaction cross sections of Se-76, Se-78, and Se-80 with an even number of neutrons begin to increase at around the point of exceeding 10 MeV. This leads to nuclear transmutation of these nuclides into Se-75, Se-77, and Se-79. Then, the (n, 2n) reaction cross sections of these Se isotopes reach a constant value at around the point of exceeding 14 MeV.

When the neutron irradiation energy still further increases, a (n, 3n) reaction cross section begins to increase at around the point of exceeding 18 MeV.

Of nuclear transmutation of the Se isotopes as shown in FIG. 2B, disadvantageous side (n, 2n) reaction is nuclear transmutation of Se-80 as the stable nuclide into Se-79 as the long-lived radionuclide. Note that nuclear transmutation of Se-82 as the stable nuclide into Se-81 as a short-lived radionuclide is acceptable because of nuclear decay of Se-81 into Br-81 (a stable nuclide) within a short period of time.

Thus, for selective transmutation of only Se-79 as the long-lived radionuclide from the Se isotopes, the value of the neutron irradiation energy is preferably set within such a range that the (n, 2n) reaction cross section of Se-79 is equal to or larger than 10 times as large as the (n, 2n) reaction cross section of Se-80, specifically a range of 7.5 MeV to 10.3 MeV.

Note that in the case of setting the neutron irradiation energy within such a range, the (n, 2n) reaction of Se-77 as the stable nuclide is also produced. However, this is not an issue because nuclear transmutation of Se-77 into Se-76 as the stable nuclide is produced.

Figures 3A, 3B:
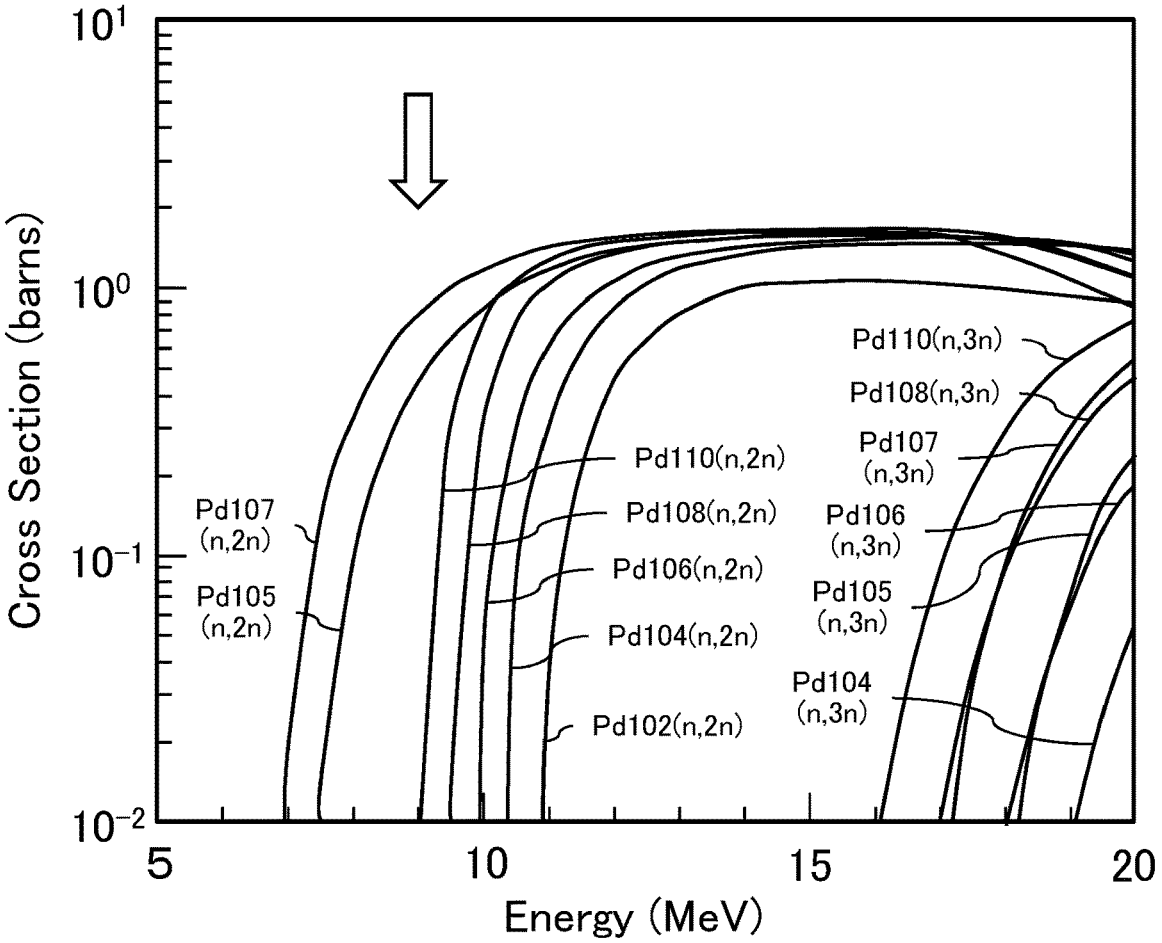
FIG. 3A is a graph of a neutron emission reaction cross section of a palladium isotope (Pd) with respect to the neutron irradiation energy.
FIG. 3B is the chart of nuclides for describing transition of the palladium isotope (Pd) by the (n, 2n) reaction.

FIG. 3A shows a graph of a neutron emission reaction cross section of a palladium isotope (Pd) with respect to the neutron irradiation energy. FIG. 3B is the chart of nuclides of major isotopes including silver Ag, palladium Pd, and rhodium Rh.

For the Pd isotopes, only Pd-102, 104, 105, 106, 108, 110 as stable nuclides and Pd-107 (a half-life of $6.5\times10^6$ years) as a long-lived radionuclide remain in the course of storage for a certain period of time and the separation extraction step (FIG. 1; S11), and almost all of other isotopes are transmuted due to nuclear decay.

Of these Pd isotopes, a target for transmuted is Pd-107 as the long-lived radionuclide.

As shown in FIG. 3A, when the neutron irradiation energy increases, the (n, 2n) reaction cross sections of Pd-105 and Pd-107 with an odd number of neutrons begin to increase at around 7 MeV. Each nuclide loses a single neutron, leading to nuclear transmutation of these nuclides into Pd-104 and Pd-106.

When the neutron irradiation energy further increases, the (n, 2n) reaction cross sections of Pd-102, 104, 106, 108, 110 with an even number of neutrons begin to increase at around the point of exceeding 9 MeV. This leads to nuclear transmutation of these nuclides into Pd-101, 103, 105, 107, 109. Then, the (n, 2n) reaction cross sections of these Pd isotopes reach a constant value at around the point of exceeding 11 MeV.

When the neutron irradiation energy still further increases, a (n, 3n) reaction cross section begins to increase at around the point of exceeding 16 MeV.

Of nuclear transmutation of the Pd isotopes as shown in FIG. 3B, disadvantageous side (n, 2n) reaction is nuclear transmutation of Pd-108 as the stable nuclide into Pd-107 as the long-lived radionuclide.

Thus, for selective transmutation of only Pd-107 as the long-lived radionuclide from the Pd isotopes, the value of the neutron irradiation energy is preferably set within such a range that the (n, 2n) reaction cross section of Pd-107 is equal to or larger than 10 times as large as the (n, 2n) reaction cross section of Pd-108, specifically a range of 7 MeV to 9.5 MeV.

Note that in the case of setting the neutron irradiation energy within such a range, nuclear transmutation of Pd-110 as the stable nuclide into Pd-109 (a half-life of 13.7 hours) as a short-lived radionuclide is produced by the (n, 2n) reaction. However, this is acceptable because nuclear decay of Pd-109 into Ag-109 as a stable nuclide is produced.

Moreover, the (n, 2n) reaction of Pd-105 as the stable nuclide is also produced. However, this is not an issue because nuclear transmutation of Pd-105 into Pd-104 as the stable nuclide is produced.

Figures 4A, 4B:
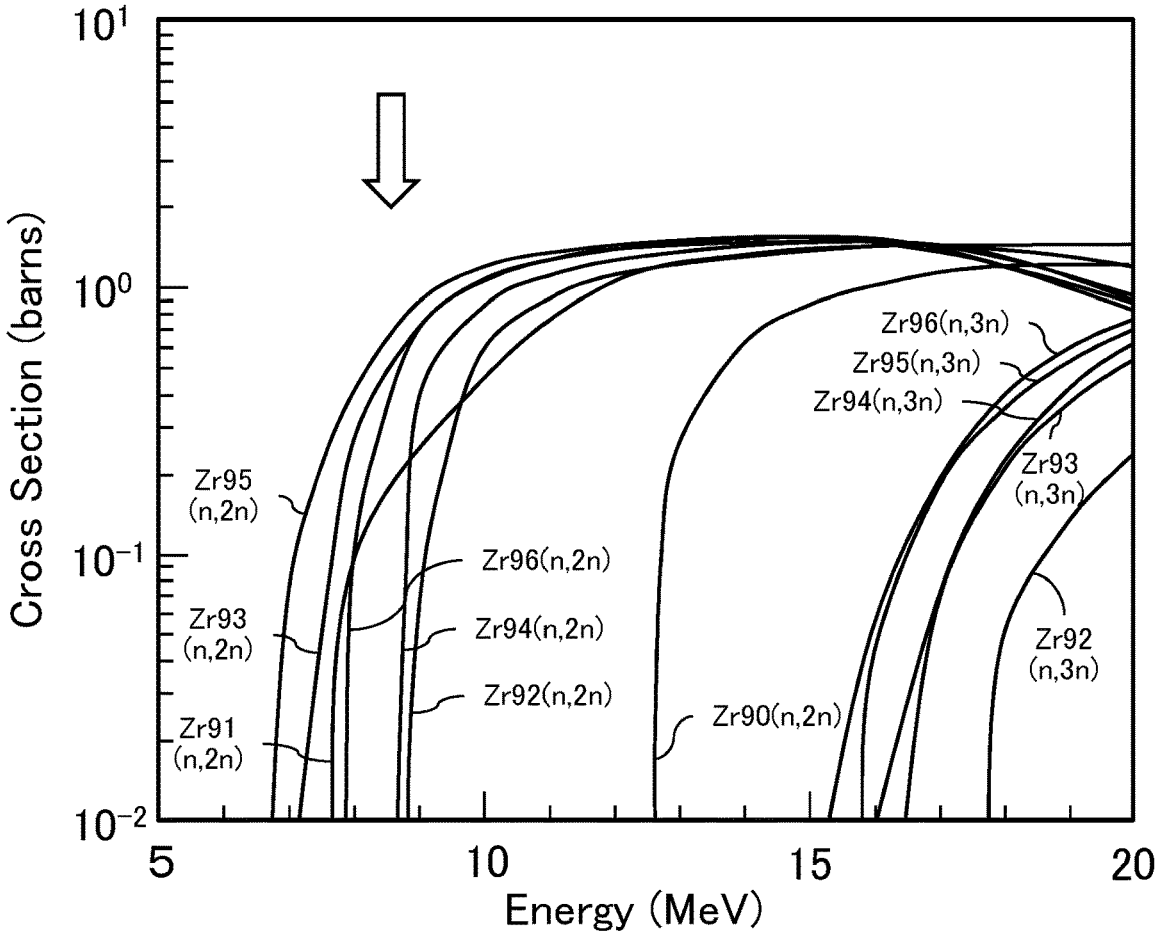
FIG. 4A is a graph of a neutron emission reaction cross section of a zirconium isotope (Zr) with respect to the neutron irradiation energy.
FIG. 4B is the chart of nuclides for describing transition of the zirconium isotope (Zr) by the (n, 2n) reaction.

FIG. 4A shows a graph of a neutron emission reaction cross section of a zirconium isotope (Zr) with respect to the neutron irradiation energy. FIG. 4B is the chart of nuclides of major isotopes including molybdenum Mo, niobium Nb, and zirconium Zr.

For the Zr isotopes, only Zr-90, 91, 92, 94, 96 as stable nuclides and Zr-93 (a half-life of $1.5\times10^6$ years) as a long-lived radionuclide remain in the course of storage for a certain period of time and the separation extraction step (FIG. 1; S11), and almost all of other isotopes are transmuted due to nuclear decay.

Of these Zr isotopes, a target for transmutation is Zr-93 as the long-lived radionuclide.

As shown in FIG. 4A, when the neutron irradiation energy increases, the (n, 2n) reaction cross sections of Zr-91, 93, 95 with an odd number of neutrons begin to increase at around 7 MeV. Each nuclide loses a single neutron, leading to nuclear transmutation of these nuclides into Zr-90, 92, 94.

When the neutron irradiation energy further increases, the (n, 2n) reaction cross sections of Zr-92, 94, 96 with an even number of neutrons begin to increase at around 8 MeV. This leads to nuclear transmutation of these nuclides into Zr-91, 93, 95.

When the neutron irradiation energy still further increases, a (n, 3n) reaction cross section begins to increase at around the point of exceeding 15 MeV.

Of nuclear transmutation of the Zr isotopes as shown in FIG. 4B, disadvantageous side (n, 2n) reaction is nuclear transmutation of Zr-94 as the stable nuclide into Zr-93 as the long-lived radionuclide.

Thus, for selective transmutation of only Zr-93 as the long-lived radionuclide from the Zr isotopes, the value of the neutron irradiation energy is preferably set within such a range that the (n, 2n) reaction cross section of Zr-93 is equal to or larger than 10 times as large as the (n, 2n) reaction cross section of Zr-94, specifically a range of 7.2 MeV to 8.7 MeV.

Note that in the case of setting the neutron irradiation energy within such a range, nuclear transmutation of Zr-96 as the stable nuclide into Zr-95 (a half-life of 64.0 days) as a short-lived radionuclide is produced by the (n, 2n) reaction. However, this is acceptable because nuclear decay of Zr-95 into Nb-95 (a half-life of 35.0 days) as a short-lived radionuclide is produced and nuclear decay of Nb-95 into Mo-95 as a stable nuclide is further produced.

Moreover, the (n, 2n) reaction of Zr-91 as the stable nuclide is also produced. However, this is not an issue because nuclear transmutation of Zr-91 into Zr-90 as the stable nuclide is produced.

Figures 5A, 5B:
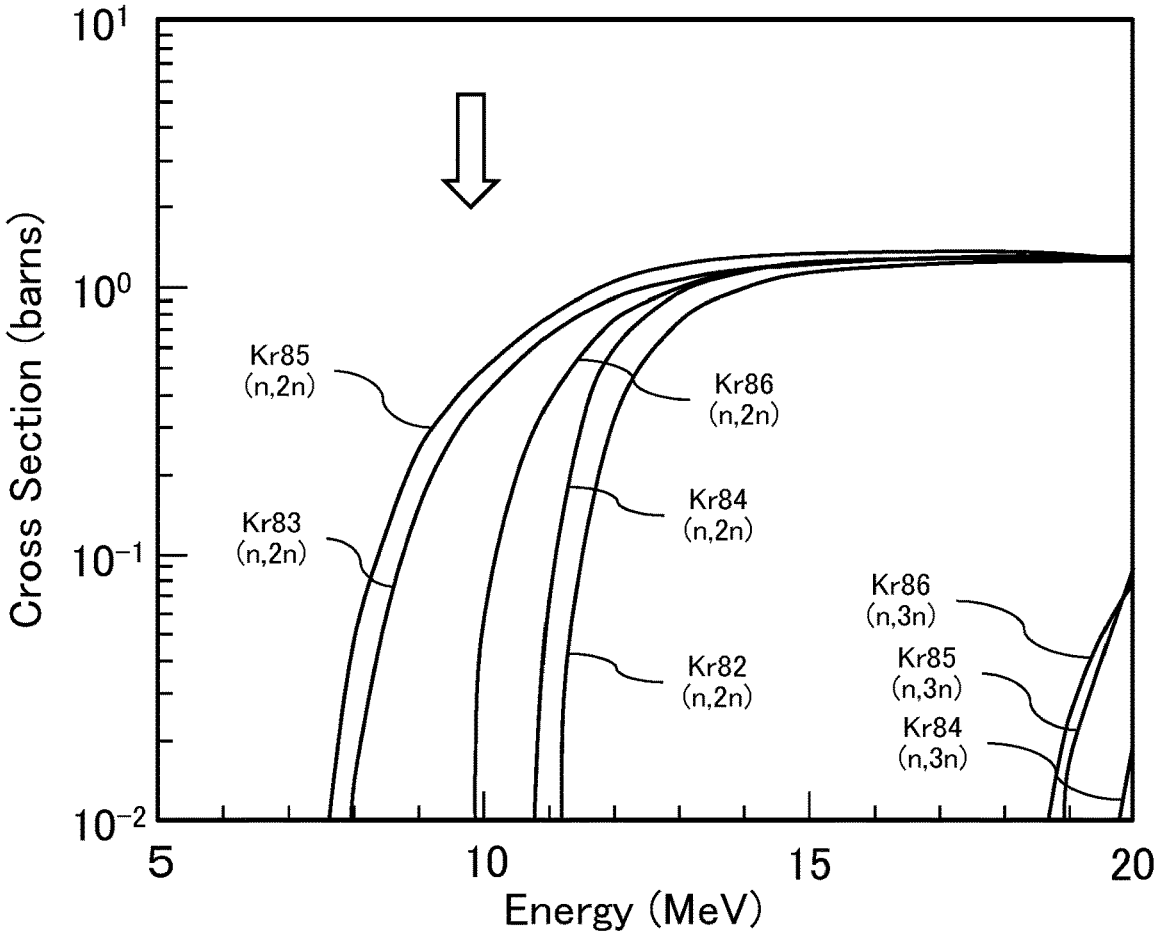
FIG. 5A is a graph of a neutron emission reaction cross section of a krypton isotope (Kr) with respect to the neutron irradiation energy.
FIG. 5B is the chart of nuclides for describing transition of the krypton isotope (Kr) by the (n, 2n) reaction.

FIG. 5A shows a graph of a neutron emission reaction cross section of a kypton isotope (Kr) with respect to the neutron irradiation energy. FIG. 5B is the chart of nuclides of major isotopes including rubidium (Rb), kypton Kr, and bromine Br.

For the Kr isotopes, only Kr-78, 80, 82, 83, 84, 86 as stable nuclides, Kr-81 (a half-life of $2.3\times10^5$ years) as a long-lived radionuclide, and Kr-85 (a half-life of 10.8 years) as a mid-lived radionuclide remain in the course of storage for a certain period of time and the separation extraction step (FIG. 1; S11), and almost all of other isotopes are transmuted due to nuclear decay.

Of these Kr isotopes, a target for transmutation is Kr-85 as the mid-lived radionuclide.

Note that the abundance of Kr-81 (a half-life of $2.29\times10^5$ years) of the Kr isotopes included in the radioactive waste is slight, and therefore, Kr-81 is taken out of consideration.

As shown in FIG. 5A, when the neutron irradiation energy increases, the (n, 2n) reaction cross sections of Kr-85 and Kr-83 with an odd number of neutrons begin to increase at around the point of exceeding 7.5 MeV. Each nuclide loses a single neutron, leading to nuclear transmutation of these nuclides into Kr-84 and Kr-82.

When the neutron irradiation energy further increases, the (n, 2n) reaction cross sections of Kr-86, Kr-84, and Kr-82 with an even number of neutrons begin to increase at around the point of exceeding 9.8 MeV. This leads to nuclear transmutation of these nuclides into Kr-85, Kr-83, and Kr-81. Then, the (n, 2n) reaction cross sections of these Kr isotopes reach a constant value at around the point of exceeding 14 MeV.

When the neutron irradiation energy still further increases, a (n, 3n) reaction cross section begins to increase at around the point of exceeding 18.5 MeV.

Of nuclear transmutation of the Kr isotopes as shown in FIG. 5B, disadvantageous side (n, 2n) reaction is nuclear transmutation of Kr-86 as the stable nuclide into Kr-85 as the mid-lived radionuclide.

Thus, for selective transmutation of only Kr-85 as the mid-lived radionuclide from the Kr isotopes, the value of the neutron irradiation energy is preferably set within such a range that the (n, 2n) reaction cross section of Kr-85 is equal to or larger than 10 times as large as the (n, 2n) reaction cross section of Kr-86, specifically a range of 7.5 MeV to 10 MeV.

Note that in the case of setting the neutron irradiation energy within such a range, the (n, 2n) reaction of Kr-83 as the stable nuclide is also produced. However, this is not an issue because nuclear transmutation of Kr-83 into Kr-82 as the stable nuclide is produced.

Figures 6A, 6B:
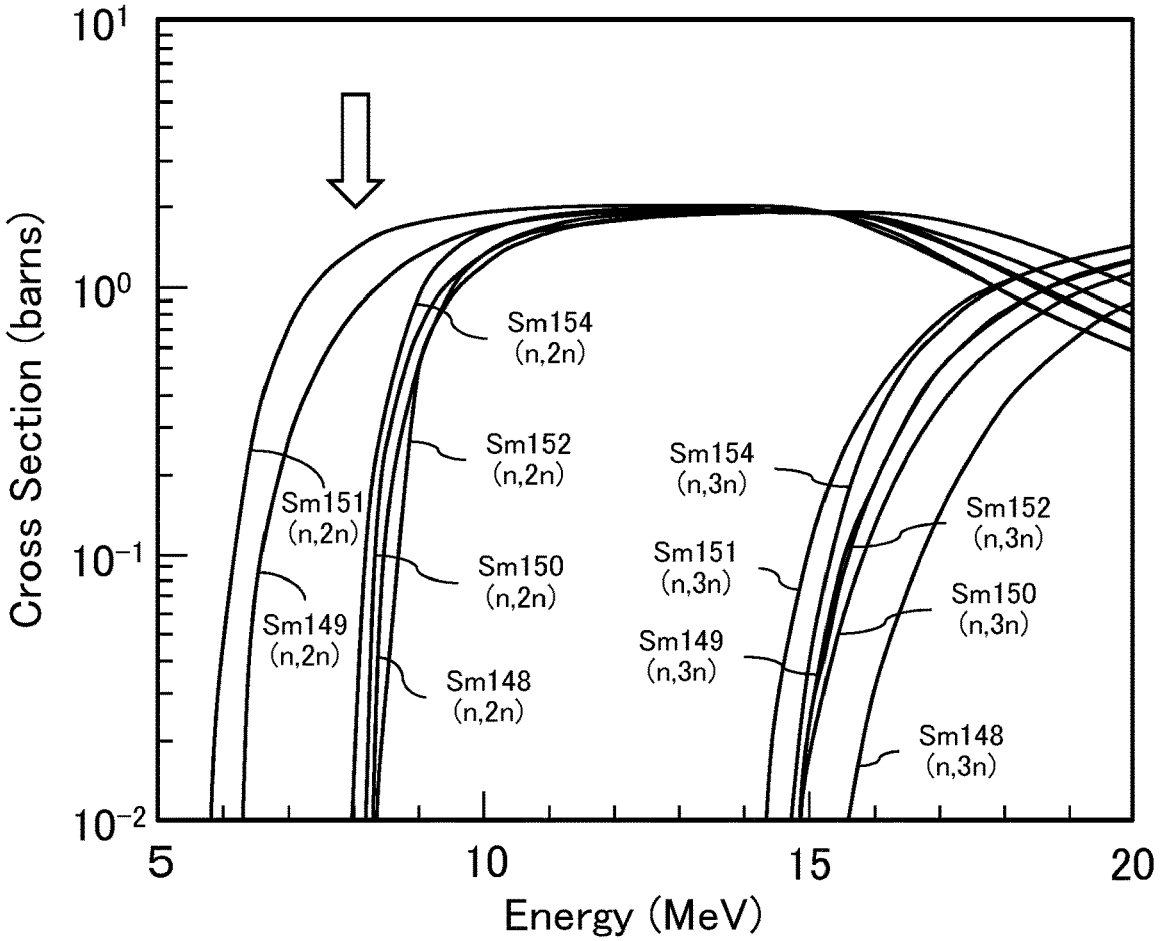
FIG. 6A is a graph of a neutron emission reaction cross section of a samarium isotope (Sm) with respect to the neutron irradiation energy.
FIG. 6B is the chart of nuclides for describing transition of the samarium isotope (Sm) by the (n, 2n) reaction.

FIG. 6A shows a graph of a neutron emission reaction cross section of a samarium isotope (Sm) with respect to the neutron irradiation energy. FIG. 6B is the chart of nuclides of major isotopes including europium (Eu), samarium (Sm), and promethium (Pm).

For the Sm isotopes, only Sm-150, 152, 154 as stable nuclides, Sm-148, 149 as metastable nuclides, and Sm-151 (a half-life of 90 years) as a mid-lived radionuclide remain in the course of storage for a certain period of time and the separation extraction step (FIG. 1; S11), and almost all of other isotopes are transmuted due to nuclear decay.

Of these Sm isotopes, a target for transmutation is Sm-151 as the mid-lived radionuclide.

Note that the abundance of each of Sm-146 (a half-life of $1.03\times10^8$ years) and Sm-147 (a half-life of $1.06\times10^{11}$ years) of the Sm isotopes included in the radioactive waste is slight, and therefore, Sm-146 and Sm-147 are taken out of consideration.

As shown in FIG. 6A, when the neutron irradiation energy increases, the (n, 2n) reaction cross sections of Sm-151 and Sm-149 with an odd number of neutrons begin to increase at around the point of exceeding 5.8 MeV. Each nuclide loses a single neutron, leading to nuclear transmutation of these nuclides into Sm-150 and Sm-148.

When the neutron irradiation energy further increases, the (n, 2n) reaction cross sections of Sm-148, Sm-150, Sm-152, and Sm-154 with an even number of neutrons begin to increase at around the point of exceeding 8 MeV. This leads to nuclear transmutation of these nuclides into Sm-147, Sm-149, Sm-151, and Sm-153. Then, the (n, 2n) reaction cross sections of these Sm isotopes reach a constant value at around the point of exceeding 11 MeV.

When the neutron irradiation energy still further increases, a (n, 3n) reaction cross section begins to increase at around the point of exceeding 14.3 MeV.

Of nuclear transmutation of the Sm isotopes as shown in FIG. 6B, disadvantageous side (n, 2n) reaction is nuclear transmutation of Sm-152 as the stable nuclide into Sm-151 as the mid-lived radionuclide.

Thus, for selective transmutation of only Sm-151 as the mid-lived radionuclide from the Sm isotopes, the value of the neutron irradiation energy is preferably set within such a range that the (n, 2n) reaction cross section of Sm-151 is equal to or larger than 10 times as large as the (n, 2n) reaction cross section of Sm-152, specifically a range of 5.8 MeV to 8.3 MeV.

Note that in the case of setting the neutron irradiation energy within such a range, the (n, 2n) reaction of Sm-148, 149 as the metastable nuclides is also produced. However, this is not an issue because nuclear transmutation of Sm-148, 149 into Sm-147, 148 which are also the metastable nuclides is produced.

Similarly, the (n, 2n) reaction of Sm-150 as the stable nuclide is also produced. However, this is not an issue because nuclear transmutation of Sm-150 into Sm-148 as the metastable nuclide is produced.

Similarly, the (n, 2n) reaction of Sm-154 as the stable nuclide is also produced. However, this is not an issue because $\beta^-$ decay of Sm-153 as a short-lived radionuclide into Eu-153 as a stable nuclide is produced within a short period of time after nuclear transmutation of Sm-154 into Sm-153.

Figures 7A, 7B:
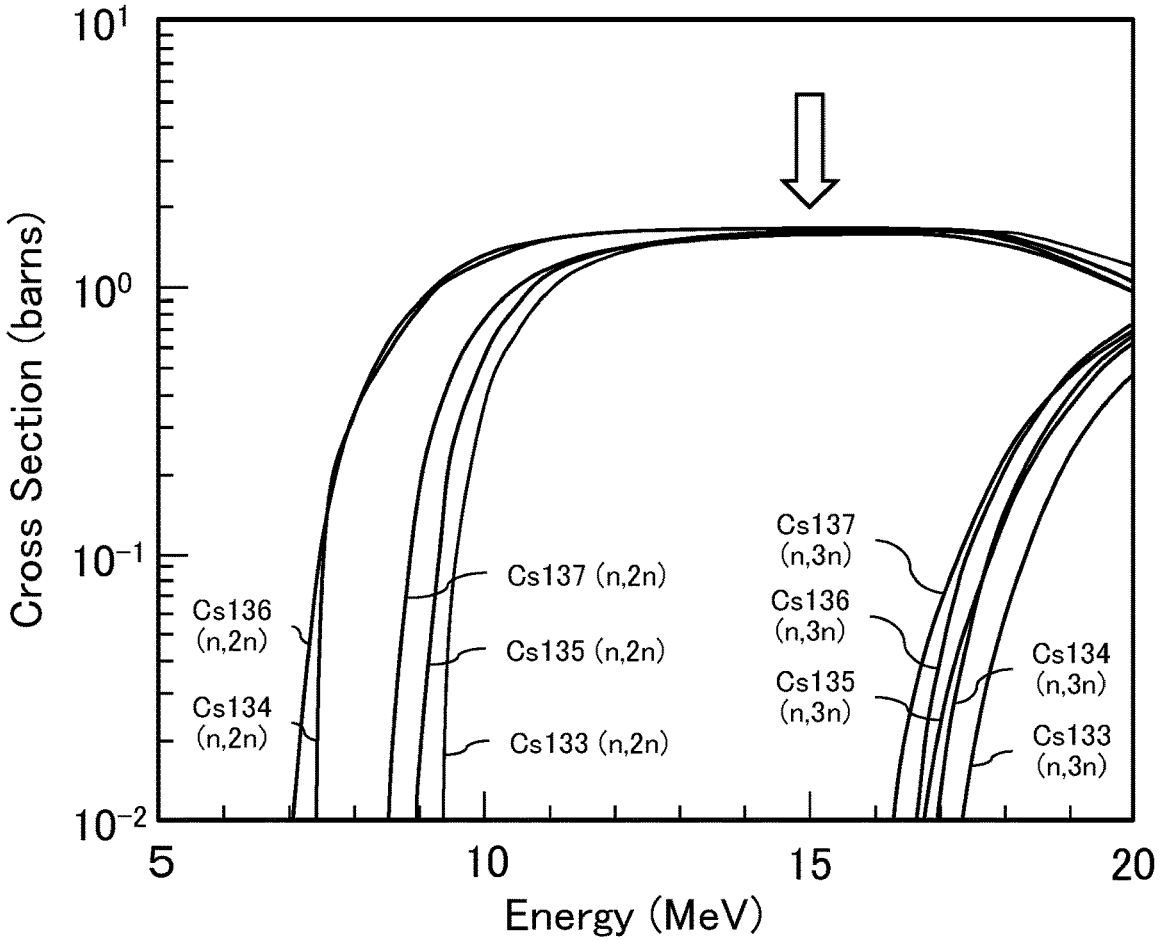
FIG. 7A is a graph of a neutron emission reaction cross section of a cesium isotope (Cs) with respect to the neutron irradiation energy.
FIG. 7B is the chart of nuclides for describing transition of the cesium isotope (Cs) by the (n, 2n) reaction.

FIG. 7A shows a graph of a neutron emission reaction cross section of a cesium isotope (Cs) with respect to the neutron irradiation energy. FIG. 7B is the chart of nuclides of major isotopes including barium Ba, cesium Cs, and xenon Xe.

For the Cs isotopes, only Cs-133 as a stable nuclide, Cs-134 (a half-life of 2.07 years) as a mid-lived radionuclide, Cs-135 (a half-life of $2.3\times10^6$ years) as a long-lived radionuclide, and Cs-137 (a half-life of 30.07 years) as a mid-lived radionuclide remain in the course of storage for a certain period of time and the separation extraction step (FIG. 1; S11), and almost all of other isotopes are transmuted due to nuclear decay.

Of these Cs isotopes, targets for transmutation are Cs-135 as the long-lived radionuclide and Cs-137 as the mid-lived radionuclide.

A difference of Cs from Se, Pd, and Zr described so far is that the number of neutrons of Cs-135 as the long-lived radionuclide is an even number, and therefore, the energy required for the (n, 2n) reaction of such a long-lived radionuclide is higher than that for the isotope nuclide with an odd number of neutrons.

As shown in FIG. 7A, when the neutron irradiation energy increases, the (n, 2n) reaction cross section of Cs begins to increase at around 7 MeV. Each of Cs-133, 134, 135, 137 loses a single neutron, leading to nuclear transmutation of these nuclides into Cs-132, 133, 134, 136. Then, the (n, 2n)

reaction cross section of Cs reaches a constant value at around the point of exceeding 11 MeV.

When the neutron irradiation energy further increases, a (n, 3n) reaction cross section begins to increase at around the point of exceeding 16 MeV.

As shown in FIG. 7B, nuclear transmutation of Cs-133 into Cs-132 (a half-life of 6.48 days) as a short-lived radionuclide is produced by the (n, 2n) reaction. Nuclear decay ($\beta^+$ decay) of Cs-132 into Xe-132 as a stable nuclide is produced.

Then, nuclear transmutation of Cs-134 into Cs-133 as the stable nuclide is produced by the (n, 2n) reaction. Nuclear transmutation of Cs-135 into Cs-134 (a half-life of 2.07 years) as the mid-lived radionuclide is produced by the (n, 2n) reaction, and nuclear decay ($\beta^-$ decay) of Cs-134 into Ba-134 as a stable nuclide is produced. Nuclear transmutation of Cs-137 into Cs-136 (a half-life of 13.2 days) as a short-lived radionuclide is produced by the (n, 2n) reaction, and nuclear decay ($\beta^-$ decay) of Cs-136 into Ba-136 as a stable nuclide is produced.

Of nuclear transmutation of the Cs isotopes, disadvantageous side (n, xn) reaction is nuclear transmutation of Cs-137 as the mid-lived radionuclide into Cs-135 as the long-lived radionuclide by (n, 3n) reaction.

Thus, for selective transmutation of Cs-135 as the long-lived radionuclide or Cs-137 as the mid-lived radionuclide from the Cs isotopes, the value of the neutron irradiation energy is preferably set within such a range that the (n, 2n) reaction cross section of Cs-137 is equal to or larger than 100 times as large as the (n, 3n) reaction cross section of Cs-137, specifically a range of 8.5 MeV to 16.2 MeV.

Note that in the case of setting the neutron irradiation energy within such a range, when Cs-136 subjected to nuclear transmutation from Cs-137 by the (n, 2n) reaction is further irradiated with neutrons, there is a concern that nuclear transmutation of such a nuclide into Cs-135 as the long-lived radionuclide is produced by the (n, 2n) reaction.

Figure 8:
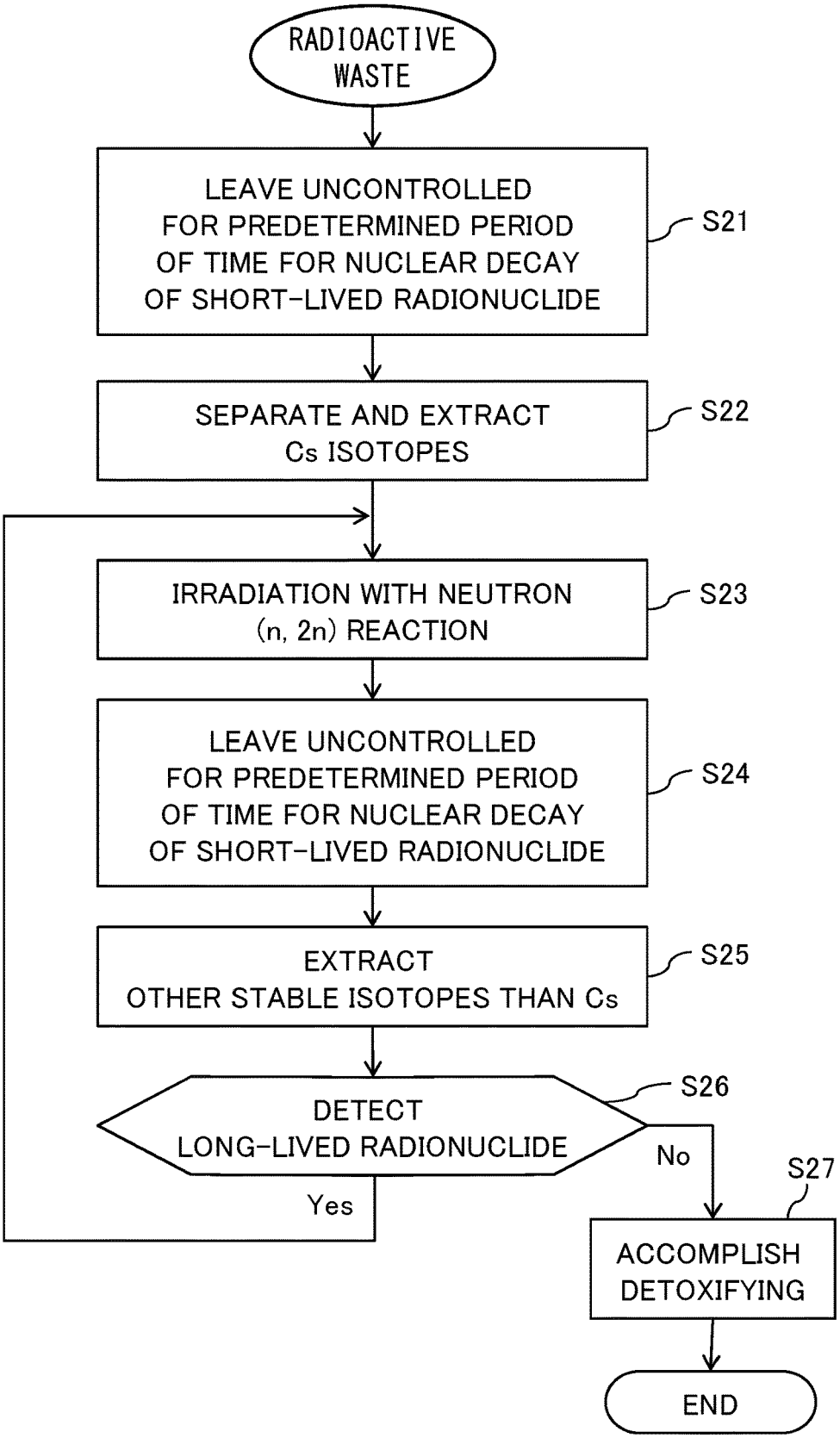
FIG. 8 is a flowchart for describing the step of processing the cesium isotope (Cs).

For this reason, the flow of the processing of the Cs isotope as illustrated in FIG. 8 will be discussed.

After the radioactive waste has been left uncontrolled for a predetermined period of time, nuclear decay of the contained short-lived radionuclides is produced (S21). Subsequently, the Cs isotopes are separated and extracted from the radioactive waste (S22), and then, are irradiated with neutrons to produce the (n, 2n) reaction (S23).

At this step of (S23), Cs-136 nuclear-transmuted from Cs-137 is, in some cases, further nuclear-transmuted, thereby generating Cs-135 as the long-lived radionuclide.

For this reason, the short-lived radionuclides such as Cs-136 are left uncontrolled for a predetermined period of time again, and are transmuted by atomic nuclear decay (S24). Then, stable isotopes of other elements than Cs are extracted, the stable isotopes being generated by nuclear decay as described above (S25).

The step (S25) of extracting the stable isotopes of other elements than Cs is not only for the purpose of eliminating disadvantageous side reaction at the subsequent neutron irradiation step (S23), but also for the purpose of obtaining useful isotope elements.

For example, only Xe-132 of multiple stable isotopes can be separated from Cs-133 by way of Cs-132.

As long as Cs-137 is present, a certain percentage of Cs-136 nuclear-transmuted by the (n, 2n) reaction is inevitably nuclear-transmuted into Cs-135 as the long-lived radionuclide (Yes at S26).

For this reason, by repeating the flow from (S23) to (Yes at S26), Cs-137 can be transmuted, and Cs-135 as the long-lived radionuclide can be also transmuted (No at S26). In this manner, detoxifying of the Cs isotopes is realized (END after S27). Moreover, by repeating the flow as described above, nuclear transmutation of Cs-135 into Xe-132 as a useful element by way of Cs-133 is produced, and Xe-132 is extracted.

Figures 9A, 9B:
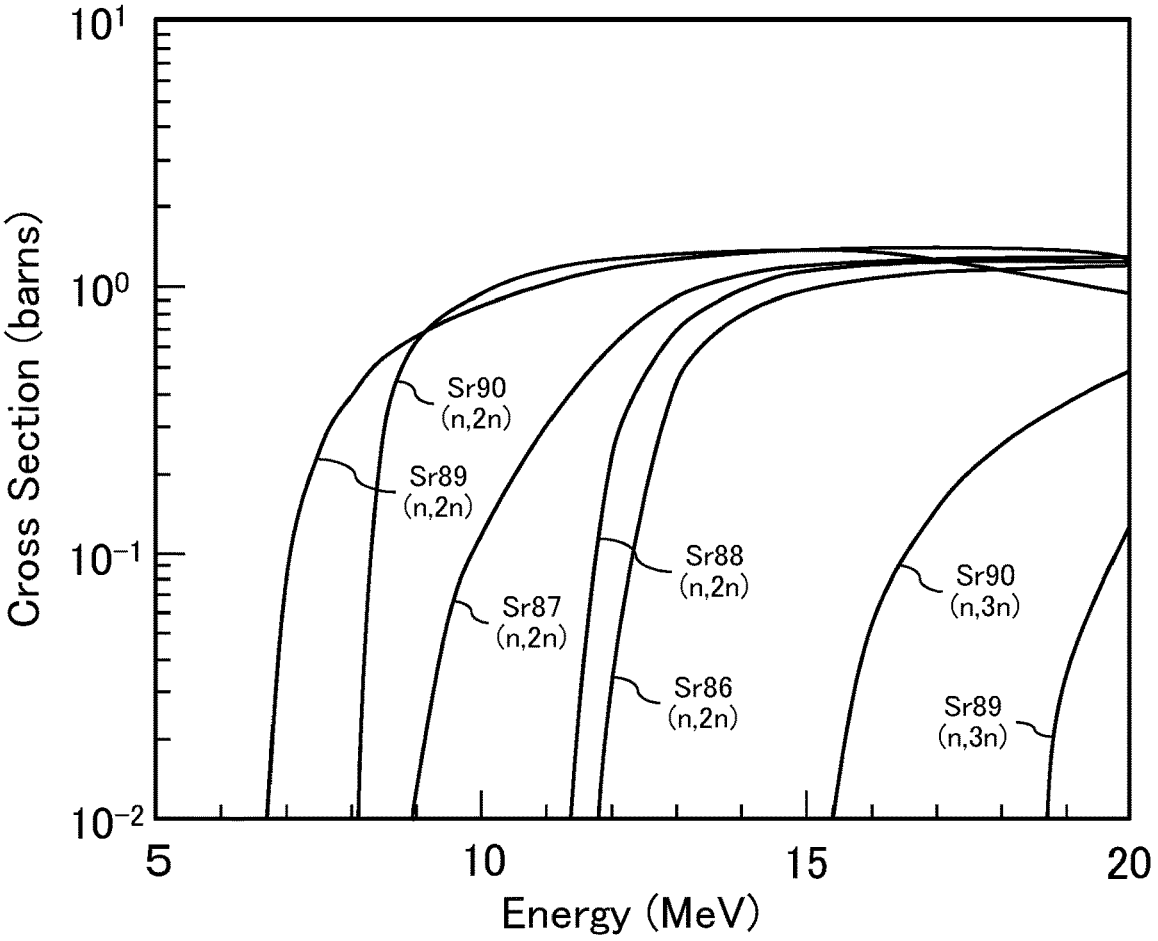
FIG. 9A is a graph of a neutron emission reaction cross section of a strontium isotope (Sr) with respect to the neutron irradiation energy.
FIG. 9B is the chart of nuclides for describing transition of the strontium isotope (Sr) by the (n, 2n) reaction.

FIG. 9A shows a graph of a neutron emission reaction cross section of a strontium isotope (Sr) with respect to the neutron irradiation energy. FIG. 9B is the chart of nuclides of major isotopes including yttrium Y, strontium Sr, and rubidium Rb.

For the Sr isotopes, only Sr-84, 86, 87, 88 as stable nuclides and Sr-90 (a half-life of 28.8 years) as a mid-lived radionuclide remain in the course of storage for a certain period of time and the separation extraction step (FIG. 1; S11), and almost all of other isotopes are transmuted due to nuclear decay.

As shown in FIG. 9A, when the neutron irradiation energy increases, the (n, 2n) reaction cross section of Sr-89 begins to increase at around 6.8 MeV. Subsequently, the (n, 2n) reaction cross section of Sr-90 begins to increase at around 8.2 MeV.

Thus, each of Sr-89, 90 loses a single neutron, leading to nuclear transmutation of these nuclides into Sr-88, 89. Sr-89 nuclear-transmuted from Sr-90 is further transmuted into Sr-88 (the stable nuclide) by the (n, 2n) reaction.

As shown in FIG. 9B, any of other Sr isotope elements than Sr-90 are a stable nuclide or a short-lived radionuclide. Thus, new long-lived and med-lived radionuclides are not generated even by the (n, 2n) reaction of all of the Sr isotopes.

For this reason, for transmutation of Sr-90, the even-odd concentration step (S12) is not necessarily undergone, and even-odd selection is not necessarily utilized for the neutron irradiation energy.

For transmutation of Sr-90 as the mid-lived radionuclide of the Sr isotopes, the value of the neutron irradiation energy may be specifically set to equal to or greater than 8.2 MeV.

Note that even when nuclear transmutation of Sr-86 (the stable nuclide) into Sr-85 (a half-life of 64.8 days) by irradiation with equal to or greater than 12 MeV is produced, this is not an issue because Sr-85 is transmuted into Rb-85 (a stable nuclide) by $\beta^+$ decay.

Figures 10A, 10B:
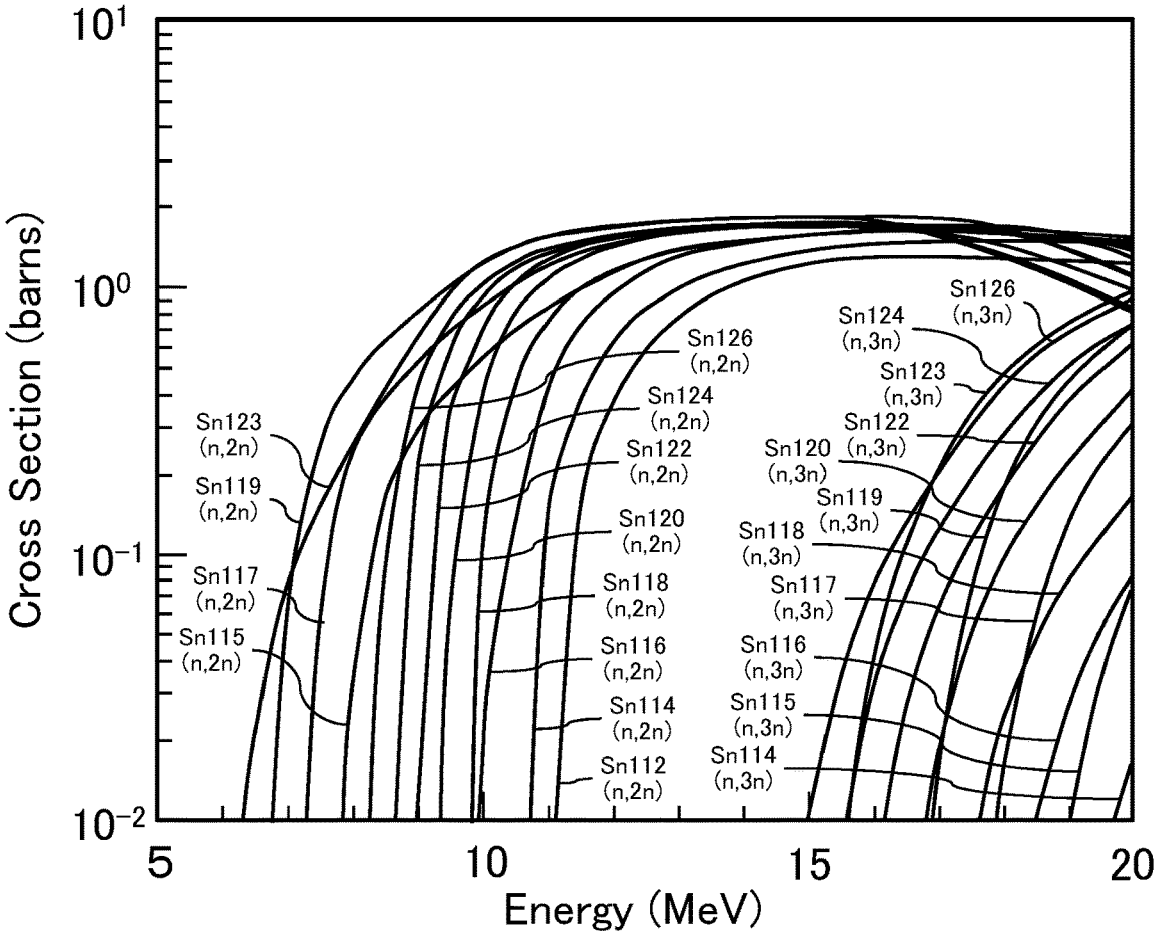
FIG. 10A is a graph of a neutron emission reaction cross section of a tin isotope (Sn) with respect to the neutron irradiation energy.
FIG. 10B is the chart of nuclides for describing transition of the tin isotope (Sn) by the (n, 2n) reaction.

FIG. 10A shows a graph of a neutron emission reaction cross section of a tin isotope (Sn) with respect to the neutron irradiation energy. FIG. 10B is the chart of nuclides of major isotopes including tellurium Te, antimony Sb, and tin Sn.

For the Sn isotopes, only Sn-112, 114, 115, 116, 117, 118, 119, 120, 122, 124 as stable nuclides and Sn-126 (a half-life of $1\times10^5$ years) as a long-lived radionuclide remain in the course of storage for a certain period of time and the separation extraction step (FIG. 1; S11), and almost all of other isotopes are transmuted due to nuclear decay.

As shown in FIG. 10A, when the neutron irradiation energy increases, the (n, 2n) reaction cross section of Sn-119 begins to increase at around 6.8 MeV. Subsequently, the (n, 2n) reaction cross section of Sn-126 begins to increase at around 8.2 MeV.

As shown in FIG. 10B, any of other Sn isotope elements than Sn-126 are a stable nuclide or a short-lived radionuclide. Thus, new long-lived and med-lived radionuclides are not generated even by the (n, 2n) reaction of all of the Sn isotopes.

For this reason, for transmutation of Sn-126, the even-odd concentration step (S12) is not necessarily undergone, and even-odd selection is not necessarily utilized for the neutron irradiation energy.

For transmutation of Sn-126 as the long-lived radionuclide of the Sn isotopes, the value of the neutron irradiation energy may be specifically set to equal to or greater than 8.2 MeV.

Note that even when nuclear transmutation of the stable nuclide of Sn is produced by irradiation with equal to or greater than 8.2 MeV, this is not an issue because a stable nuclide of another element is generated by further $\beta^-$ decay or $\beta^+$ decay.

(Neutron Beam Generation Device)

A secondarily-generated beam generated utilizing an accelerator is applied as a neutron beam for inducing the (n, 2n) reaction of the isotopes.

In this accelerator, protons are accelerated to energy slightly higher than target neutron energy, and a target is irradiated with the protons. In this manner, neutrons are generated. Alternatively, in this accelerator, deuterons are accelerated to total energy about twice as high as target neutron energy, and a target is irradiated with the deuterons. In this manner, neutrons are generated.

Such a target structure is designed to control the strength and profile (the degree of convergence) of the generated neutrons, and therefore, a beam-shaped neutron bundle is output.

(Muon Nuclear Capture Reaction)

Figure 11:
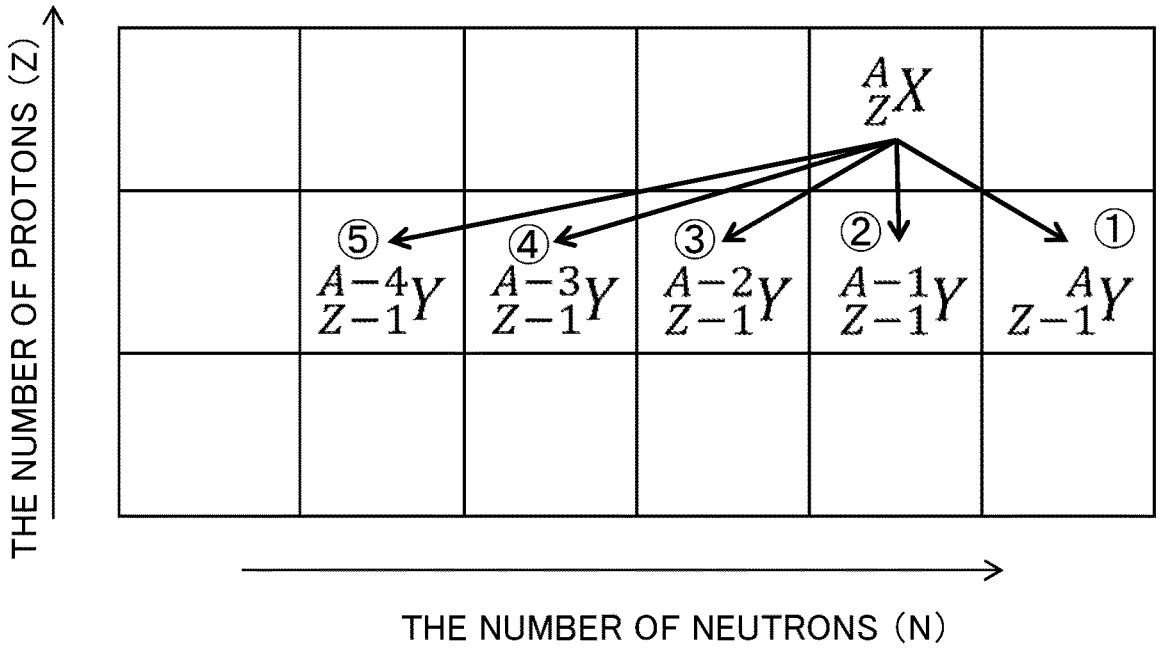
FIG. 11 is a chart for describing muon nuclear capture reaction.

Next, a case where the high-energy particles with which the isotopes is irradiated are muon $\mu^-$ will be described based on FIG. 11. Note that muon includes positive muon $\mu^+$ and negative muon $\mu^-$. The present invention is targeted for the negative muon and therefore, the muon described below all indicates the negative muon.

When the muon $\mu^-$ is captured by an atomic nucleus of an element X, one of protons forming the atomic nucleus is transmuted into a neutron when bonded to the muon $\mu^-$. Then, a neutrino $\nu$ is emitted (Reaction Formula (1)). Then, nuclear transmutation into an element Y with a (Z−1) atomic nucleus of which number of protons is reduced by one is produced.

As shown in Reaction Formulae (2) to (5), such an element Y shows an excited state, and the nucleus reaction for emitting one or more neutrons n is produced.

$$(\mu^-, \nu) \text{ reaction: } \mu^- + X(Z,A) \rightarrow Y((Z-1), A) + \nu \quad (1)$$

$$(\mu^-, n\nu) \text{ reaction: } Y((Z-1), (A)) \rightarrow n + Y((Z-1), (A-1)) \quad (2)$$

$$(\mu^-, 2n\nu) \text{ reaction: } Y((Z-1), (A)) \rightarrow 2n + Y((Z-1), (A-2)) \quad (3)$$

$$(\mu^-, 3n\nu) \text{ reaction: } Y((Z-1), (A)) \rightarrow 3n + Y((Z-1), (A-3)) \quad (4)$$

$$(\mu^-, 4n\nu) \text{ reaction: } Y((Z-1), (A)) \rightarrow 4n + Y((Z-1), (A-4)) \quad (5)$$

Reaction Formulae (1) to (5) as described above are symbolized as shown in FIG. 11, and are shown as 1 to 5.

Multiple muon nuclear capture reactions are simultaneously produced at a predetermined rate depending on the element X. It has been found, as an experimental example, that for iodine I-127, the occurrence rates of the ($\mu^-$, $\nu$) reaction, the ($\mu^-$, n$\nu$) reaction, the ($\mu^-$, 2n$\nu$) reaction, the ($\mu^-$, 3n$\nu$) reaction, the ($\mu^-$, 4n$\nu$) reaction, and the ($\mu^-$, 5n$\nu$) reaction are 8%, 52%, 18%, 14%, 5%, and 2.5%, respectively.

(Muon Beam Generation Device)

A muon beam for inducing the ($\mu^-$, xn$\nu$) reaction of the isotopes is obtained as follows. That is, a target such as carbon is irradiated with a proton beam with an energy of about 800 MeV, and in this manner, negative pion is generated. Then, this generated pion (a life of 2.6 nanoseconds) is decayed, and in this manner, a negative muon beam is obtained.

FIG. 12 is the chart of nuclides for describing transition of the selenium isotopes (Se) by the muon nuclear capture reaction.

For the Se isotopes, only Se-74, 76, 77, 78, 80, 82 as the stable nuclides and Se-79 (a half-life of $2.95\times10^5$ years) as the long-lived radionuclide remain in the course of storage for the certain period of time and the separation extraction step (FIG. 1; S11), and almost all of other isotopes are transmuted due to nuclear decay.

In the case of focusing on Se-79, when such a Se isotopes is irradiated with the muon $\mu^-$, nuclear transmutation reactions $^{79}Se(\mu^-, \nu)^{79}As$, $^{79}Se(\mu^-, n\nu)^{78}As$, $^{79}Se(\mu^-, 2n\nu)^{77}As$, and $^{79}Se(\mu^-, 3n\nu)^{76}As$ are produced.

As-76, As-77, As-78, and As-79 generated as described above are short-lived radionuclides. Thus, nuclear decay ($\beta^-$ decay) of these radionuclides is produced within a short period of time, and the radionuclides are transmuted into Se-76, Se-77, Se-78, and Se-79.

That is, for Se-79 as the long-lived radionuclide, some of the nuclides transmuted by the muon nuclear capture reaction are transmuted back into Se-79, but the remaining nuclides are the Se stable nuclides.

For Se-80, 82 of Se-74, 76, 77, 78, 80, 82, some of the nuclides transmuted by muon irradiation are also Se-79 as the long-lived radionuclide.

As described above, in the case of irradiating the Se isotopes with the muon $\mu^-$, the transmuted nuclides are transmuted back due to $\beta^-$ decay. Thus, Se-79 cannot be transmuted by one-time irradiation, but can be decreased.

For this reason, concentration of Se-77, 79 with an odd number of neutrons among the Se isotopes by way of the even-odd concentration step (FIG. 1; S12) will be discussed.

Of the transmuted nuclides from Se-77 (the stable nuclide), As-77 is transmuted back into Se-77 by $\beta^-$ decay, As-76 is transmuted into Se-76 (the stable nuclide) by $\beta^-$ decay, As-75 is present as a stable nuclide, and As-74 is transmuted into Se-74 (the stable nuclide) by $\beta^-$ decay and Ge-74 (a stable nuclide) by $\beta^+$ decay.

Although transmutation of some of the transmuted As nuclides of Se-79 back into Se-79 cannot be avoided, Se-79 can be efficiently decreased by one-time muon irradiation. This is because the transmuted As nuclides of Se-77 are not transmuted back into Se-79.

FIG. 13 is the chart of nuclides for describing transition of the palladium isotopes (Pd) by the muon nuclear capture reaction.

For the Pd isotopes, only Pd-102, 104, 105, 106, 108, 110 as the stable nuclides and Pd-107 (a half-life of $6.5\times10^6$ years) as the long-lived radionuclide remain in the course of storage for the certain period of time and the separation extraction step (FIG. 1; S11), and almost all of other isotopes are transmuted due to nuclear decay.

In the case of focusing on Pd-107, when such a Pd isotopes is irradiated with the muon $\mu^-$, nuclear transmutation reactions $^{107}Pd(\mu^-, \nu)^{107}Rh$, $^{107}Pd(\mu^-, n\nu)^{106}Rh$, $^{107}Pd(\mu^-, 2n\nu)^{105}Rh$, and $^{107}Pd(\mu^-, 3n\nu)^{104}Rh$ are produced.

Rh-104, Rh-105, Rh-106, Rh-107 generated as described above are short-lived radionuclides. Thus, nuclear decay ($\beta^-$ decay) of these radionuclides is produced within a short period of time, and the radionuclides are transmuted into Pd-104, Pd-105, Pd-106, and Pd-107.

That is, for Pd-107 as the long-lived radionuclide, some of the nuclides transmuted by the muon nuclear capture reaction are transmuted back into Pd-107, but the remaining nuclides are the Pd stable nuclides.

For Pd-108, 110 of Pd-102, 104, 105, 106, 108, 110, some of the nuclides transmuted by muon irradiation are also Pd-107 as the long-lived radionuclide.

As described above, in the case of irradiating the Pd isotopes with the muon $\mu^-$, the transmuted nuclides are transmuted back due to $\beta^-$ decay. Thus, Pd-107 cannot be transmuted by one-time irradiation, but can be decreased.

For this reason, concentration of Pd-105, 107 with an odd number of neutrons among the Pd isotopes by way of the even-odd concentration step (FIG. 1; S12) will be discussed.

Of the transmuted nuclides from Pd-105 (the stable nuclide), Rh-105 is transmuted back into Pd-105 by $\beta^-$ decay, Rh-104 is transmuted into Pd-104 (the stable nuclide) by $\beta^-$ decay and Ru-104 (a stable nuclide) by $\beta^+$ decay, Rh-103 is present as a stable nuclide, and Rh-102 is transmuted into Pd-102 (the stable nuclide) by $\beta^-$ decay and Ru-102 (a stable nuclide) by $\beta^+$ decay.

Although transmutation of some of the transmuted Rh nuclides of Pd-107 back into Pd-107 cannot be avoided, Pd-107 can be efficiently decreased by one-time muon irradiation. This is because the transmuted Rh nuclides of Pd-105 are not transmuted back into Pd-107.

FIG. 14 is the chart of nuclides for describing transition of the strontium isotopes (Sr) by the muon nuclear capture reaction.

For the Sr isotopes, only Sr-84, 86, 87, 88 as the stable nuclides and Sr-90 (a half-life of 28.8 years) as the mid-lived radionuclide remain in the course of storage for the certain period of time and the separation extraction step (FIG. 1; S11), and almost all of other isotopes are transmuted due to nuclear decay.

In the case of focusing on Sr-90, when such a Sr isotopes is irradiated with the muon $\mu^-$, nuclear transmutation reactions $^{90}Sr(\mu^-, \nu)^{90}Rb$, $^{90}Sr(\mu^-, n\nu)^{89}Rb$, $^{90}Sr(\mu^-, 2n\nu)^{88}Rb$, and $^{90}Sr(\mu^-, 3n\nu)^{87}Rb$ are produced.

Rb-87 generated as described above is a metastable nuclide, and Rb-88, Rb-89, and Rb-90 generated as described above are short-lived radionuclides. Thus, nuclear decay ($\beta^-$ decay) of these nuclides is produced within a short period of time, and these nuclides are transmuted into Sr-88, Sr-89, and Sr-90. Sr-89 is further transmuted into Y-89 as a stable nuclide by $\beta^-$ decay.

That is, for Sr-90 as the mid-lived radionuclide, some of the nuclides transmuted by the muon nuclear capture reaction are transmuted back into Sr-90, but the remaining nuclides are Sr stable nuclides, Y stable nuclides, or Rb metastable nuclides.

The rest of Sr-84, 86, 87, 88 are also eventually transmuted into stable nuclides or metastable nuclides by muon irradiation.

FIG. 15 is the chart of nuclides for describing transition of the zirconium isotopes (Zr) by the muon nuclear capture reaction.

For the Zr isotopes, only Zr-90, 91, 92, 94, 96 as the stable nuclides and Zr-93 (a half-life of $1.5\times10^6$ years) as the long-lived radionuclide remain in the course of storage for the certain period of time and the separation extraction step (FIG. 1; S11), and almost all of other isotopes are transmuted due to nuclear decay.

In the case of focusing on Zr-93, when such a Zr isotopes is irradiated with the muon $\mu^-$, nuclear transmutation reactions $^{93}Zr(\mu^-, \nu)^{93}Y$, $^{93}Zr(\mu^-, n\nu)^{92}Y$, $^{93}Zr(\mu^-, 2n\nu)^{91}Y$, and $^{93}Zr(\mu^-, 3n\nu)^{90}Y$ are produced.

Y-90, Y-91, Y-92, and Y-93 generated as described above are short-lived radionuclides. Thus, nuclear decay ($\beta^-$ decay) of these radionuclides is produced within a short period of time, and these radionuclides are transmuted into Zr-90, Zr-91, Zr-92, and Zr-93.

That is, for Zr-93 as the long-lived radionuclide, some of the nuclides transmuted by the muon nuclear capture reaction are transmuted back into Zr-93, but the remaining nuclides are Zr stable nuclides.

For Zr-94, 96 of Zr-90, 91, 92, 94, 96, some of the nuclides transmuted by muon irradiation are also Zr-93 as the long-lived radionuclide.

As described above, in the case of irradiating the Zr isotopes with the muon $\mu^-$, the transmuted nuclides are transmuted back due to $\beta^-$ decay. Thus, Zr-93 cannot be transmuted by one-time irradiation, but can be decreased.

For this reason, concentration of Zr-91, 93 with an odd number of neutrons among the Zr isotopes by way of the even-odd concentration step (FIG. 1; S12) will be discussed.

Of the transmuted nuclides from Zr-91 (the stable nuclide), Y-90, 91 are transmuted into Zr-90, 91 (the stable nuclides) by $\beta^-$ decay, Y-89 is present as the stable nuclide, and Y-88 is transmuted into Sr-88 (the stable nuclide) by $\beta^+$ decay.

Although transmutation of some of the transmuted Y nuclides of Zr-93 back into Zr-93 cannot be avoided, Zr-93 can be efficiently decreased by one-time muon irradiation. This is because the transmuted Y nuclides of Zr-91 are not transmuted back into Zr-93.

FIG. 16 is the chart of nuclides for describing transition of the cesium isotopes (Cs) by the muon nuclear capture reaction.

For the Cs isotopes, only Cs-133 as the stable nuclide, Cs-134 (a half-life of 2.07 years) as the mid-lived radionuclide, Cs-135 (a half-life of $2.3\times10^6$ years) as the long-lived radionuclide, and Cs-137 (a half-life of 30.07 years) as the mid-lived radionuclide remain in the course of storage for the certain period of time and the separation extraction step (FIG. 1; S11), and almost all of other isotopes are transmuted due to nuclear decay.

In the case of focusing on Cs-137, when such a Cs isotopes is irradiated with the muon $\mu^-$ nuclear transmutation reactions $^{137}Cs(\mu^-, \nu)^{137}Xe$, $^{137}Cs(\mu^-, n\nu)^{136}Xe$, $^{137}Cs(\mu^-, 2n\nu)^{135}Xe$, and $^{137}Cs(\mu^-, 3n\nu)^{134}Xe$ are produced. Moreover, in the case of focusing on Cs-135, nuclear transmutation reactions $^{135}Cs(\mu^-, \nu)^{135}Xe$, $^{135}Cs(\mu^-, n\nu)^{134}Xe$, $^{135}Cs(\mu^-, 2n\nu)^{133}Xe$, and $^{135}Cs(\mu^-, 3n\nu)^{132}Xe$ are produced.

Xe-137 and Xe-135 generated as described above are short-lived radionuclides. Thus, nuclear decay ($\beta^-$ decay) of these radionuclides is produced within a short period of time, and these radionuclides are transmuted into Cs-137 and Cs-135.

That is, for Cs-137, 135 as the long-lived radionuclides, some of the nuclides transmuted by the muon nuclear capture reaction are transmuted back into Cs-137, 135, but the remaining nuclides eventually become stable nuclides.

FIG. 17 is the chart of nuclides for describing transition of the tin isotopes (Sn) by the muon nuclear capture reaction.

For the Sn isotopes, only Sn-112, 114, 115, 116, 117, 118, 119, 120, 122, 124 as the stable nuclides and Sn-126 (a half-life of $1\times10^5$ years) as the long-lived radionuclide remain in the course of storage for the certain period of time and the separation extraction step (FIG. 1; S11), and almost all of other isotopes are transmuted due to nuclear decay In the case of focusing on Sn-126, when such a Sn isotopes is irradiated with the muon $\mu^-$, nuclear transmutation reactions $^{126}Sn(\mu^-, \nu)^{126}In$, $^{126}Sn(\mu^-, n\nu)^{125}In$, $^{126}Sn(\mu^-, 2n\nu)^{124}In$, and $^{126}Sn(\mu^-, 3n\nu)^{123}In$ are produced.

In-123, 124, 125, 126 generated as described above are short-lived radionuclides. Thus, nuclear decay ($\beta^-$ decay) of these radionuclides is produced within a short period of time, and these radionuclides are transmuted into Sn-123, 124, 125, 126.

That is, for Sn-126 as the long-lived radionuclide, some of the nuclides transmuted by the muon nuclear capture reaction are transmuted back into Sn-126, but the remaining nuclides eventually become stable nuclides.

The rest of Sn-112, 114, 115, 116, 117, 118, 119, 120, 122, 124 also eventually become stable nuclides by muon irradiation.

FIG. 18 is the chart of nuclides for describing transition of the samarium isotopes (Sm) by the muon nuclear capture reaction.

For the Sm isotopes, only Sm-150, 152, 154 as the stable nuclides, Sm-147, 148, 149 as the metastable nuclides, Sm-146 (a half-life of $1\times10^8$ years) as a long-lived radionuclide, and Sm-151 (a half-life of 90 years) as the mid-lived radionuclide remain in the course of storage for the certain period of time and the separation extraction step (FIG. 1; S11), and almost all of other isotopes are transmuted due to nuclear decay.

In the case of focusing on Sm-151, when such a Sm isotopes is irradiated with the muon $\mu^-$, nuclear transmutation reactions $^{151}Sm(\mu^-, \nu)^{151}Pm$, $^{151}Sm(\mu^-, n\nu)^{150}Pm$, $^{151}Sm(\mu^-, 2n\nu)^{149}Pm$, and $^{151}Sm(\mu^-, 3n\nu)^{148}Pm$ are produced.

Pm-148, 149, 150, 151 generated as described above are short-lived radionuclides. Thus, nuclear decay ($\beta^-$ decay) of these radionuclides is produced within a short period of time, and these radionuclides are transmuted into Sm-148, 149, 150, 151.

That is, for Sm-151 as the long-lived radionuclide, some of the nuclides transmuted by the muon nuclear capture reaction are transmuted back into Sm-151, but the remaining nuclides eventually become stable nuclides.

For Sm-150, 152 of Sm-146, 147, 148, 149, 150, 152, 154, some of the nuclides transmuted by muon irradiation are also Sm-151 as the mid-lived radionuclide.

As described above, in the case of irradiating the Sm isotopes with the muon $\mu^-$, the transmuted nuclides are transmuted back due to $\beta^-$ decay. Thus, Sm-151 cannot be transmuted by one-time irradiation, but can be decreased.

For this reason, concentration of Sm-151, 149, 147 with an odd number of neutrons among the Sm isotopes by way of the even-odd concentration step (FIG. 1; S12) will be discussed.

Although transmutation of some of the transmuted Pm nuclides of Sm-151 back into Sm-151 cannot be avoided, Sm-151 can be efficiently decreased by one-time muon irradiation. This is because the transmuted Pm nuclides of Sm-149 are not transmuted back into Sm-151.

Moreover, the transmuted nuclide Pm-147 of Sm-147 (the metastable nuclide) is transmuted back into Sm-147 by $\beta^-$ decay, and other transmuted nuclides Pm-144, 145, 146 are transmuted into Nd stable nuclides or metastable nuclides by $\beta^+$ decay.

According to the method for processing the radioactive waste according to at least one embodiment described above, the separated and extracted isotopes is irradiated with the high-energy particles, and in this manner, only the radionuclides can be selectively transmuted into the stable nuclides in the fission products.

According to such a radioactive waste processing method, isotope separation is not necessary, and the stable nuclides transmuted from the long-lived radionuclides or the like can be reutilized as a resource.

Some embodiments of the present invention have been described. However, these embodiments have been set forth merely as examples, and are not intended to limit the scope of the invention. These embodiments can be implemented in other various forms, and various omissions, replacements, changes, and combinations can be made without departing from the gist of the invention. These embodiments and variations thereof are included in the scope and gist of the invention, as well as being included in the invention described in the claims and an equivalent scope thereof.

The invention claimed is:

1. A method for processing radioactive waste, comprising:

a step of extracting a group of isotopes having a same atomic number from the radioactive waste, followed by no separation process of isotopes from the extracted group, the extracted group including a radionuclide and stable nuclides; and a step of generating a neutron (n) by an accelerator and irradiating the neutron (n) to the isotopes, so as to produce nuclear transmutation of a first nuclide as a long-lived radionuclide into a second nuclide as a stable nuclide, while suppressing nuclear transmutation of a third nuclide into the first nuclide by setting a value of irradiation energy of the neutron (n) within such a range that a (n, 2n) reaction cross section of the first nuclide is equal to or larger than 10 times as large as a (n, 2n) reaction cross section of the third nuclide, and wherein the isotopes, the first nuclide, the second nuclide, and the third nuclide are defined as below:

selenium (Se) isotopes, Se-79, Se-78, and Se-80, respectively;

palladium (Pd) isotopes, Pd-107, Pd-106, and Pd-108, respectively;

zirconium (Zr) isotopes, Zr-93, Zr-92, and Zr-94, respectively;

krypton (Kr) isotopes, Kr-85, Kr-84, and Kr-86, respectively; or samarium (Sm) isotopes, Sm-151, Sm-150, and Sm-152, respectively.

2. The radioactive waste processing method according to claim 1, further comprising:

after the extracting step and before the irradiating step, a step of increasing or decreasing a ratio of isotopes having an odd number of neutrons with respect to isotopes having an even number of neutrons in the extracted group of isotopes, by inducing an isotopic shift phenomenon in the extracted group of isotopes.

* * * * *